US005386102A

United States Patent [19]

Takikawa et al.

[11] Patent Number: 5,386,102

[45] Date of Patent: Jan. 31, 1995

[54] COOKER

[75] Inventors: Hiroyoshi Takikawa; Yoshio Yoshida; Nobuko Kakimoto; Shinsuke Ise, all of Kanagawa, Japan

[73] Assignee: Mitsubishi Denki Kabushiki Kaisha, Tokyo, Japan

[21] Appl. No.: 752,598

[22] PCT Filed: Dec. 14, 1990

[86] PCT No.: PCT/JP90/01636

§ 371 Date: Aug. 13, 1991

§ 102(e) Date: Aug. 13, 1991

[87] PCT Pub. No.: WO91/09508

PCT Pub. Date: Jun. 27, 1991

[30] Foreign Application Priority Data

| | | | |
|---|---|---|---|
| Dec. 14, 1989 | [JP] | Japan | 1-32215 |
| Dec. 14, 1989 | [JP] | Japan | 1-322609 |
| Dec. 14, 1989 | [JP] | Japan | 1-322610 |
| Dec. 14, 1989 | [JP] | Japan | 1-322611 |
| Dec. 14, 1989 | [JP] | Japan | 1-322613 |
| Dec. 25, 1989 | [JP] | Japan | 1-332776 |
| Dec. 25, 1989 | [JP] | Japan | 1-332777 |
| Dec. 25, 1989 | [JP] | Japan | 1-332779 |
| Jul. 23, 1990 | [JP] | Japan | 2-193100 |
| Aug. 7, 1990 | [JP] | Japan | 2-209500 |
| Nov. 28, 1990 | [JP] | Japan | 2-323113 |

[51] Int. Cl.[6] ..... H05B 6/12

[52] U.S. Cl. ..... 21/620; 219/621; 219/627; 219/652; 99/348

[58] Field of Search ..... 219/10.75, 10.55 F, 219/10.55 B, 10.79, 10.71, 620, 621, 622, 625, 626, 627, 652; 99/331, 348, 427

[56] References Cited

FOREIGN PATENT DOCUMENTS

| | | |
|---|---|---|
| 164717 | 5/1981 | Japan . |
| 195886 | 8/1987 | Japan . |
| 175375 | 7/1988 | Japan . |

*Primary Examiner*—Bruce A. Reynolds
*Assistant Examiner*—Tu Hoang
*Attorney, Agent, or Firm*—Wolf, Greenfield & Sacks

[57] ABSTRACT

A cooker in which a receptacle with a pot for holding ingredients and a heater for induction heating the pot is supported by a main unit so that it can be inclined freely, consists of an angle control unit which provides driving force for inclining the receptacle to the receptacle, a controller for controlling the angle control unit, and shall be capable of automatically inclining the receptacle and uniformly sautéing the ingredients.

15 Claims, 31 Drawing Sheets

FIG.8(a)
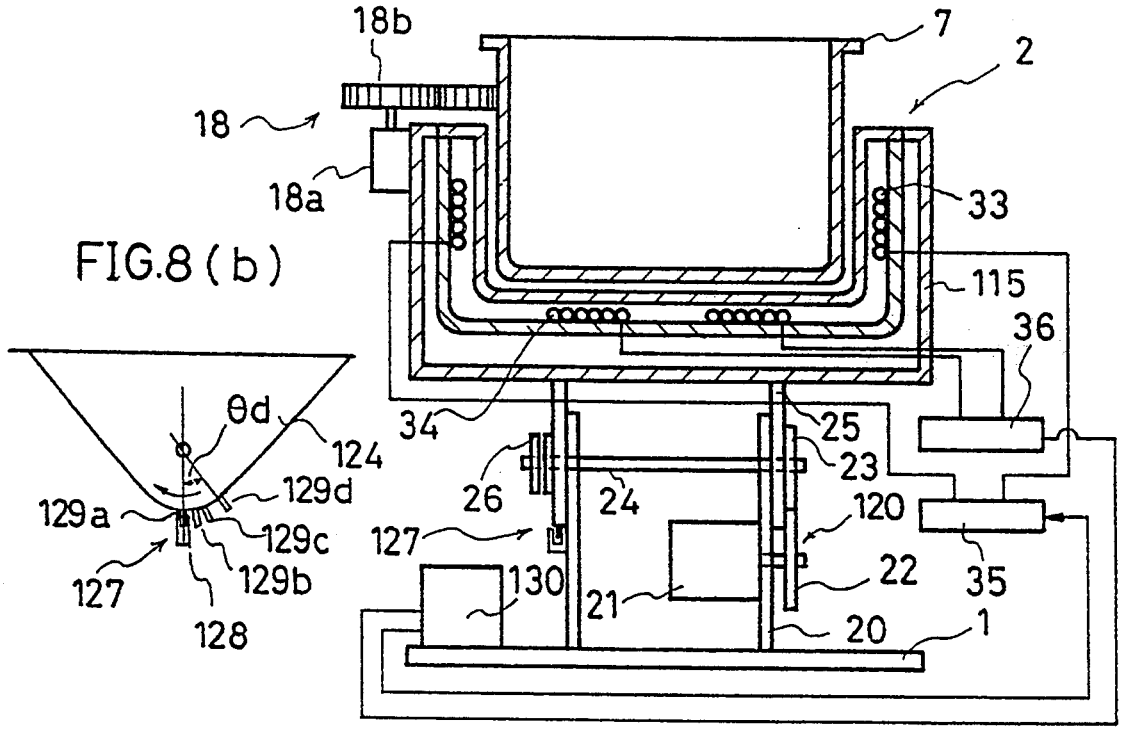
FIG.8(b)
FIG.8(c)
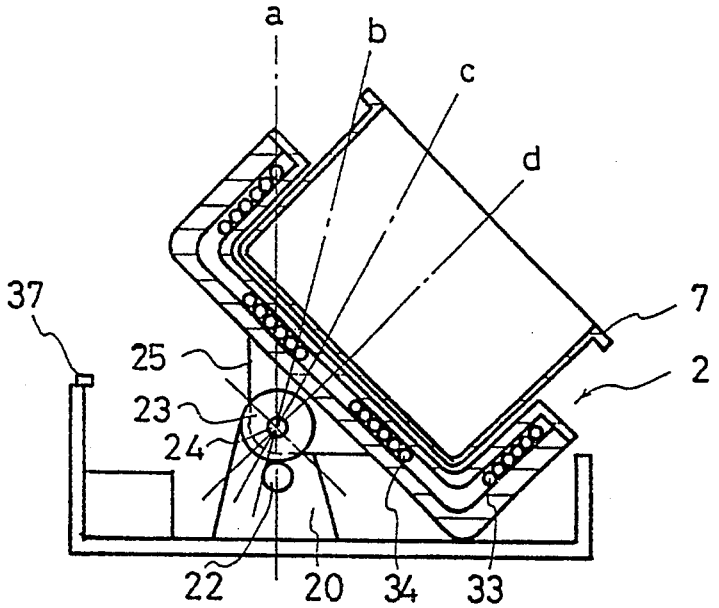

COOKER

BACKGROUND OF THE INVENTION

1. Field of the Invention

The present invention relates to a cooker which uses induction heating to heat a pot for cooking by sautéing or other means.

2. Description of the Prior Art

Progress in technology which uses induction heating to heat magnetic pots has led to the recent development of rotary cookers which use induction heating to heat rotary pots for automatic sautéing. An electromagnetic cooker disclosed in the Japanese Patent Application Laid-Open No. 63-175375 is such an example, and FIG. 33 shows a partial cross-section of the side of the cooker.

In FIG. 33, receptacle 2 is mounted on top of main unit 1, which has a built-in heating power supply, by hinge 3 so that it can rotate freely, and supported and fixed by support member 4 at a desired inclination angle. Support member 4 consists of first support lever **4*b* and second support lever 4*c* which are joined together by pin 4*a*, and supports and fixes receptacle 2 at a desired angle by tightening pin 4*a*. Pot 7 is located at the central part of receptacle 2 in such a way that it can be rotated on axis 9 by driving unit 8 at the bottom. Induction heating coil 6 is wired around pot 7 via heat insulator 5. Lid 10 is screwed onto the top of receptacle 2 and slip ring 11 is provided between lid 10 and pot 7 to prevent ingredients inside pot 7 from escaping from receptacle 2. In addition, there is small lid 12 on the central top of the lid for inserting seasonings. Numbers 13 and 14 are control units for rotation speed and heating temperature or time, respectively, and 15** is ingredients.

As an example to sauté ingredients, using the cooker described above, incline receptacle 2 at a desired angle by support member 4 and turn on induction heating coil 6 to heat the outside of pot 7 while actuating driving unit 8 to rotate pot 7. Then, put oil into pot 7 and stop the rotation when oil spreads all over pot 7. Put ingredients 15 to be sautéed into the pot, cover with lid 10 and rotate pot 7. Then, ingredients 15 are heated, stirred and sautéed within pot 7. At a proper time, open small lid 12 to add seasonings and cooking is over.

The conventional electromagnetic cooker is configured and used as described above.

(a) However, since receptacle 2 of the above electromagnetic cooker is inclined manually, it is not easy to use. There is a risk of users' getting burnt especially when changing the inclination angle of the receptacle during operation, .

(b) The pot for holding ingredients is heated by induction heating coil 6. However, heating coil 6 consists of only one layer, thus providing-only a single cooking pattern. Therefore, the cooker can do only sautéing, and is thus limited in its application range.

(c) The types of cooking possible with this cooker is limited.

(d) In addition, its heating method is very simple, cooking methods and heating times are limited, resulting in a narrow application range.

(e) As the rotation speed of the pot is fixed and does not change during cooking, it has been difficult to enhance the sautéing performance.

(f) Induction heating coil 6 is wired between the side and the bottom of cooking pot 7 via heat insulator 5 to heat ingredients 15 inside the pot from the outside. Therefore, when cooking pot 7 is inclined, the top of cooking pot 7 where there are no ingredients is also heated, resulting in a waste of electricity as well as a large size, complex structure and high production cost for induction heating coil 6.

(g) Furthermore, since cooking pot 7 is rotated at a fixed speed and heated uniformly, ingredients 15 do not contact all parts of cooking pot 7, thus take a long time to cook. In addition, induction heating coil 6 is wired between the side and the bottom of cooking pot 7 via heat insulator 5 to heat ingredients 15 from the outside. Therefore, when cooking pot 7 is inclined, the top of cooking pot where there are no ingredients 15 is heated, resulting in a waste of electricity, and a large size, complex structure and high production cost for induction heating coil 6.

(h) Cooking pot 7 fixed on the tip of rotary axis 9 is rotated by actuating driving unit 8. Flange **7*a* of cooking pot 7 is rotated while in contact with slip ring 11 fixed on stationary lid 10 to seal up the pot. Therefore, too tight a sealing results in increased friction, the wearing of contact surfaces, and the generation of a gap which hinders the rotation of cooking pot 7. On the other hand, too loose a sealing results in soup running out from the gap to the inside of receptacle 2. Since cooking pot 7** is fixed, it is difficult to clean after cooking and, accordingly, it becomes easily dirty.

(i) When ingredients are to be sautéed, for instance, users must feel the temperature of the pot from the ambient temperature by putting their hands into cooking pot 7. Therefore, there is a risk of their getting burnt when they put their hands into the pot. Since the temperature of the cooking pot is unknown during cooking, heating temperature is controlled by the perception and experience of users. As a result, they cannot go away from the rotary cooker during cooking. If they go away from the cooker, the temperature of the cooking pot goes too high, resulting in scorching and an eventual danger of fire. In addition, when the cooking pot is heated continuously without ingredients inside, it becomes too hot and damages the receptacle.

(j) Cooking using the electromagnetic cooker is carried out as described above. Since the cooking temperature is unknown, the timing for adding oil and seasonings and the timing for taking out sautéed food rely on the perception and experience of cooks. In addition, if cooks go away from the cooker during cooking, ingredients are scorched and there is a danger of fire.

SUMMARY OF THE INVENTION (a) The first embodiment overcomes the above problems of the conventional cooker. It is therefore an object of the first embodiment to provide a cooker which enables users to freely change the inclination angle of the pot for holding ingredients during cooking without fear of getting burnt.

(b) It is an object of the second embodiment to provide an easy-to-use rotary cooker which enables various types of cooking.

(c) It is an object of the third embodiment to provide a rotary cooker which enables users to select the inclination angle of the receptacle freely and set a cooking program according to type of cooking in order to prepare their desired meals automatically.

(d) It is an object of the fourth embodiment to provide a rotary cooker which is configured in such a way that the inclination angle of the cooking pot and the heating temperature range can be changed, enabling users to set cooking programs by selecting the inclination angle and heating temperature range according to the type of cooking in order to automate cooking according to programs.

(e) It is an object of the fifth embodiment to provide a rotary cooker which is equiped with a device to change the rotation speed of the pot for enhanced sautéing performance.

(f) It is an object of the sixth embodiment to provide an economical electromagnetic cooker which is low priced and eliminates electricity waste.

(g) It is an object of the seventh embodiment to provide an inexpensive and economical cooker which can change the rotation of the cooking pot regularly or at random, and which combines concentrated heating by stopping the rotation and stirring/heating by changing the rotation speed of the cooking pot regularly or at random, thus making it ideal for cooking that requires strong heat.

(h) It is an object of the eighth embodiment to provide a cooker which can maintain airtightness between the cooking pot and the pot lid very easily, and which features high ease of operation.

(i) It is an object of the ninth embodiment to provide an easy-to-use cooker which can optimize the temperature of the cooking pot for cooking, sautéing for instance, and incorporates programs of cooking conditions for various types of cooking so that desired meals can be prepared automatically according to the type of cooking.

(j) It is an object of the tenth embodiment to provide a safe and easy-to-use rotary cooker which displays cooking temperatures and enables anyone to prepare good meals without reliance on his/her perception and experience.

In order to attain the above mentioned objects, the present invention is constructed as follows. (a) According to the first embodiment as shown in FIGS. 1 to 3, a cooker in which a receptacle with a pot for holding ingredients and a heater for induction heating the pot is supported by a main unit so that it can be inclined freely comprises an angle control unit which provides driving force for inclining the receptacle to said receptacle and a controller for controlling the angle control unit. (*b*) According to the second embodiment as shown in FIG. 7, a cooker in which a receptacle with a pot for holding ingredients and a heater for induction heating the pot is supported by a main unit so that it can be inclined freely comprises an angle control unit which provides driving force for inclining the receptacle to the receptacle and a controller for controlling said angle control unit.

Induction heating coils which constitute said heater consist of a coil for heating the bottom of the pot and a coil for heating the side of said pot, each of which is equipped with input control means and input switching means to heat the side or bottom only or both of them simultaneously.

(c) According to the third embodiment as shown in FIGS. 4 to 6, a cooker in which a receptacle with a pot for holding ingredients and a heater for induction heating the pot is supported by a main unit so that it can be inclined freely comprises an angle control unit which provides driving force for inclining the receptacle to said receptacle, a controller for controlling the angle control unit, an angle detector, and a memory for storing an angle setting program.

Said controller can control the inclination angle of said cooking pot so as to make the angle detected by the angle detector coincide with the angle preset by the angle setting program.

(d) According to the fourth embodiment as described in FIGS. 8 to 10, a cooker in which a receptacle with a pot for holding ingredients and a heater for induction heating the pot is supported by a main unit so that it can be inclined freely comprises an angle control unit which provides driving force for inclining the receptacle to the receptacle, a controller for controlling the angle control unit, an angle detector, a memory for storing an angle setting program and activation time setting program, and a timer.

Said controller can control the inclination angle of the receptacle so as to make the angle detected by the angle detector coincide with the angle preset by said angle setting program, and control the activation time for the heater so as to make the time preset by the activation time setting program coincide with the time measured by the timer.

(e) According to the fifth embodiment as shown in FIG. 11, a cooker in which a receptacle with a pot for holding ingredients, a rotation structure for rotating the pot and a heater for induction heating the pot is supported by a main unit so that it can be inclined freely comprises an angle control unit which provides driving force for inclining the receptacle to said receptacle, a controller for controlling the angle control unit, and a device for changing the rotation speed of said pot.

(f) According to the sixth embodiment as shown in FIGS. 13 to 15, a cooker in which a receptacle with a pot for holding ingredients, a rotation structure for rotating the pot and a heater for induction heating the pot is supported by a main unit so that it can be inclined freely comprises an angle control unit which provides driving force for inclining said receptacle to the receptacle, a controller for controlling the angle control unit.

The induction heating coil of the induction heater is wired around the lowest part of the inclined pot.

(g) According to the seventh embodiment as shown in FIGS. 16 to 20, a cooker in which a receptacle with a pot for holding ingredients, a rotation structure for rotating the pot and a heater for induction heating the pot is supported by a main unit so that it can be inclined freely comprises an angle control unit which provides driving force for inclining said receptacle to said receptacle, a controller for controlling the angle control unit, and a device for changing the rotation speed of said pot.

Said device for changing the rotation speed of said pot can heat said ingredients concentratedly with the induction heater by stopping intermittently or decelerating the rotation of the pot.

(h) According to the eighth embodiment as shown in FIG. 21, a cooker in which a receptacle with a pot for holding ingredients and a heater for induction heating the pot is supported by a main unit so that it can be inclined freely comprises an angle control unit which provides driving force for inclining the receptacle to said receptacle, a controller for controlling the angle control unit, and a pot lid with a port on the pot.

(i) According to the ninth embodiment as shown in FIGS. 22 to 25, a cooker in which a receptacle with a pot for holding ingredients and a heater for induction heating the pot is supported by a main unit so that it can be inclined freely comprises an angle control unit which provides driving force for inclining the receptacle to said receptacle, a controller for controlling the angle control unit, a temperature detector in contact with the pot for detecting the temperature of the pot, and cooking condition control means for controlling cooking conditions according to cooking programs based on type of cooking for the ingredients and temperatures detected by the temperature detector. (j) According to the tenth embodiment as shown in FIGS. 26 to 32, a cooker in which a receptacle with a pot for holding ingredients and a, heater for induction heating the pot is supported by a main unit so that it can be inclined freely comprises an angle control unit which provides driving force for inclining the receptacle to said receptacle, a controller for controlling the angle control unit, a contact with a thermosensitive device, transport means for bringing this contact into contact or out of contact with the outside of the pot and temperature measurement means for measuring the detection temperature of the thermosensitive device.

The above and other objects, features, and advantages of the present invention will become more apparent from the following description when taken in conjunction with the accompanying drawings.

BRIEF DESCRIPTION OF THE DRAWINGS

FIG. 8 (*a*) is a diagram showing the side of the inclining unit of the receptacle and FIGS. 8 (*b*) and (*c*) are enlarged diagrams showing the key parts of an embodiment of a cooker according to the invention;

DESCRIPTION OF THE PREFERRED EMBODIMENT

Figure 1:
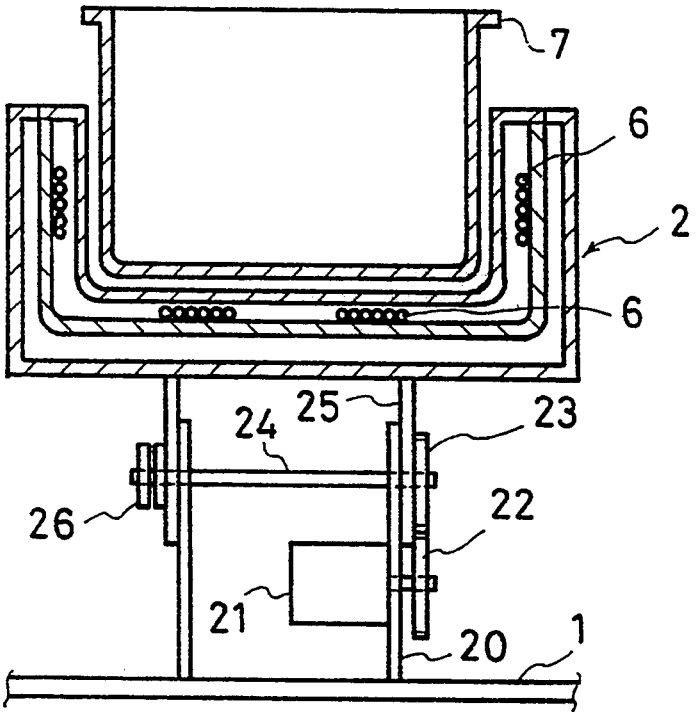
FIG. 1 is a diagram showing a partial cross-section of the front of an embodiment of a cooker according to the present invention.
Figure 2:
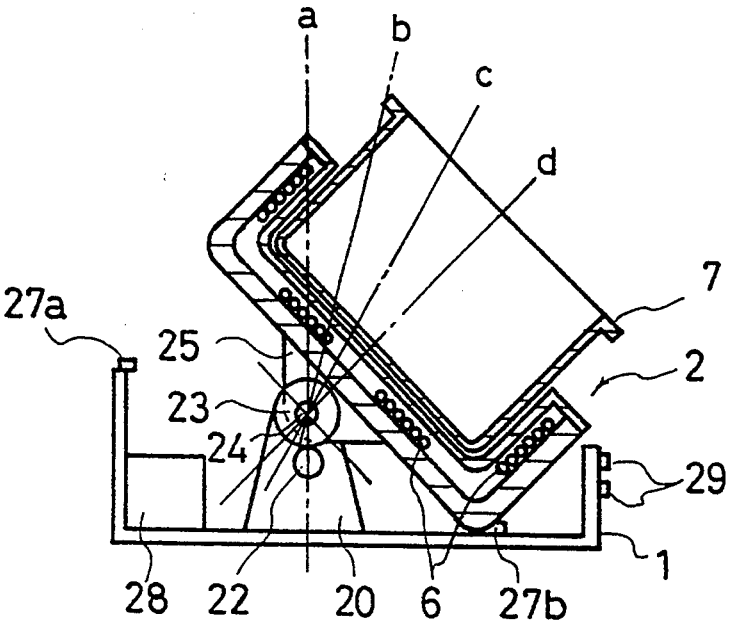
FIG. 2 is a diagram showing a partial cross-section of the side of the embodiment.

FIG. 1 shows a partial cross-section of the side and FIG. 2 a partial cross-section of the front of a cooker according to the first embodiment.

Numbers 1 to 7 in the figure refer to the same or equivalent parts as those of conventional cookers. Number 20 is a support, 21 driving motor, 22 first gear, 23 second gear, 24 their axis, 25 bracket, 26 brake, 27*a* and *b* limit switches, 28 control circuit and 29 operation switch.

As shown in the figure, ingredients are placed inside pot 7 of the rotary cooker and cooked by rotating pot 7 with a rotating unit (not shown in the figure), heating it with induction heating coils 6 and inclining receptacle 2, when necessary.

In the above rotary cooker according to the invention, a receptacle inclining unit consists of an inclination angle control unit, an inclination angle retention unit and a controller. The inclination angle control unit is furnished with driving motor 21 fixed on support 20, first gear 22 coupled with the axis of motor 21 and second gear 23 engaged with the first gear. Bracket 25 fixed at the bottom of receptacle 2 is fitted with second gear 23 and can rotate freely on axis 24 supported by support 20. Therefore, when driving motor 21 is started, bracket 25 fixed on second gear 23 rotates at the same time as first gear 22 and second gear 23 engaged with the first gear rotate. receptacle 2 fixed on bracket 25 is accordingly inclined around axis 24. That is, receptacle 2 is inclined by the starting of motor 21. In addition, the angle retention unit can incline receptacle 2 at a desired angle by starting brake 26 when the inclination angle reaches a desired angle, and maintain the desired angle. To incline and maintain receptacle 2 at a desired angle of inclination, controller 28 is actuated by the operation of switch 29. Therefore, the inclination angle of receptacle 2 can be changed during cooking.

Figure 3:
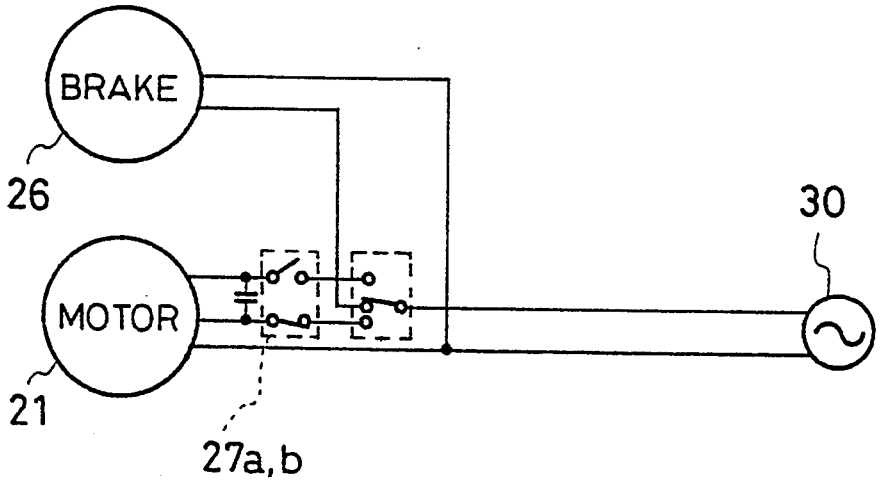
FIG. 3 is a diagram illustrating the control circuit.

As shown in FIG. 2, the inclination angle of receptacle 2 can be selected freely between horizontal position a of pot 7 and position d when receptacle 2 contacts the bottom of main unit 1. For this purpose, main unit 1 is furnished with limit switches 27*a* and 27*b* so that when receptacle 2 touches limit switch 27*a* or 27*b* at horizontal position a and maximum inclined position d, motor 21 stops operation. FIG. 3 shows the control circuit of the controller for the above operation.

In this embodiment, the angle control unit uses gears, but ball screws, links and cams can be used instead of gears to control the angle of inclination.

Since the cooker according to the present invention incorporates a receptacle inclining unit which consists of an angle control unit for inclining a receptacle at a desired angle, an angle retention unit for keeping the receptacle inclined at the desired angle and a controller, it allows the receptacle to be freely inclined through switch operation during cooker operation, thus greatly improving the operational ease of the cooker.

Figure 4:
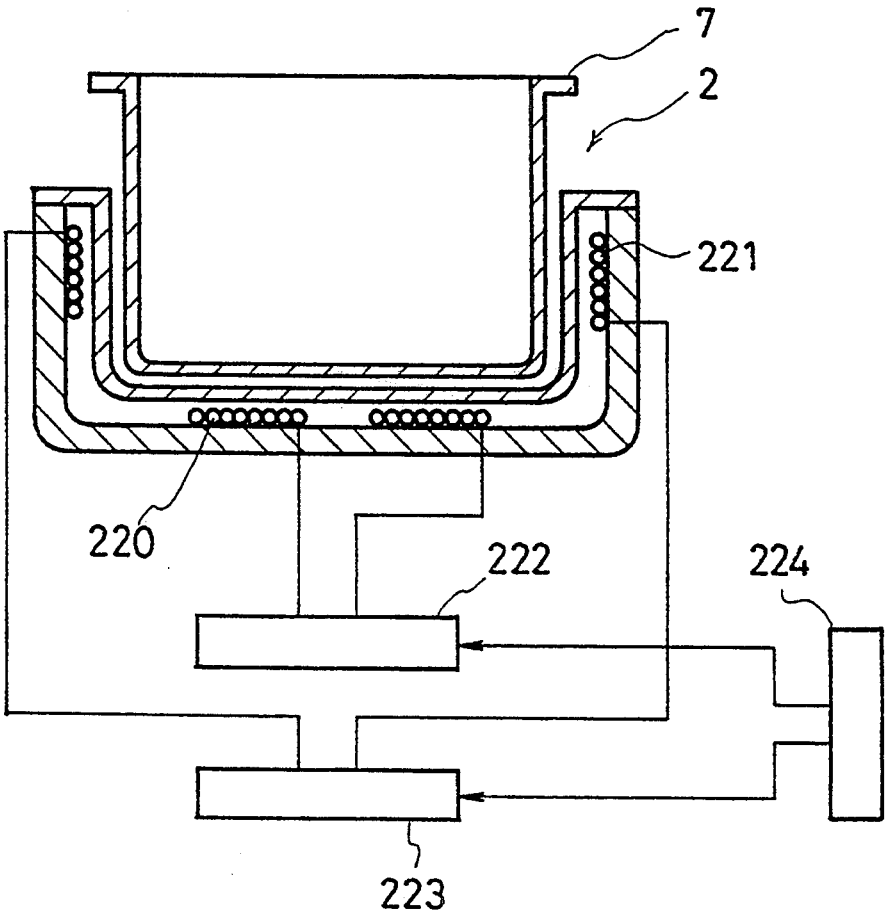
FIG. 4 is a diagram showing a cross-section of the receptacle of an embodiment of a cooker according to the invention.
Figure 33:
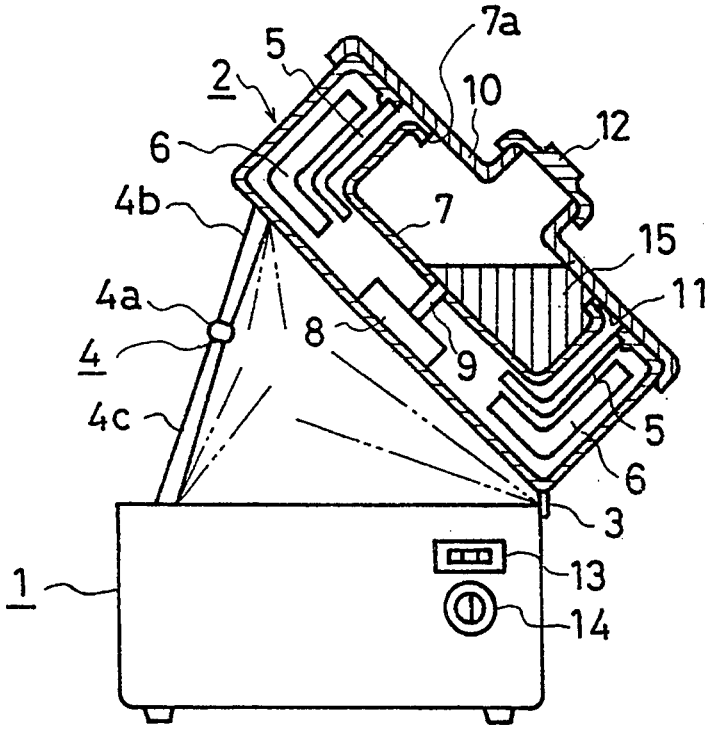
FIG. 33 PRIOR ART
FIG. 33 is a diagram showing an example of a conventional electromagnetic cooker.

FIG. 4 is a diagram showing a cross-section of the receptacle of a cooker according to the second embodiment. In the figure, number 7 is a pot, 20 first coil, 21 second coil, 22 first coil input controller, 23 second coil input controller, and 24 input switch. The cooker incorporates an angle control unit and a controller described in FIG. 33.

In the figure, a pot rotation driving unit and a receptacle inclining unit are omitted.

As shown in the figure, heating coils consist of the first coil for heating the bottom of the pot and the second coil for heating the side of the pot. Input switch 24 is used to turn on the first or second coil only or both of them.

As a result, only the first coil is used for roasting meat, while only the second coil is used for preparing curry and stew. For sautéing vegetables and noodles, it is recommended to use both of these coils.

In this way, the cooker can change heating methods according to type of cooking, resulting in an increased types of meals to be prepared by this rotary cooker, expanded application range and improved operational ease of the cooker.

According to the present invention, the rotary cooker incorporates heating means which consist of the first coil for heating the pot bottom and the second coil for heating the pot side to heat the pot by using either one of them or both of them, thus greatly increasing the types of meals to be prepared by this rotary cooker and improving its operational ease.

Figure 5A:
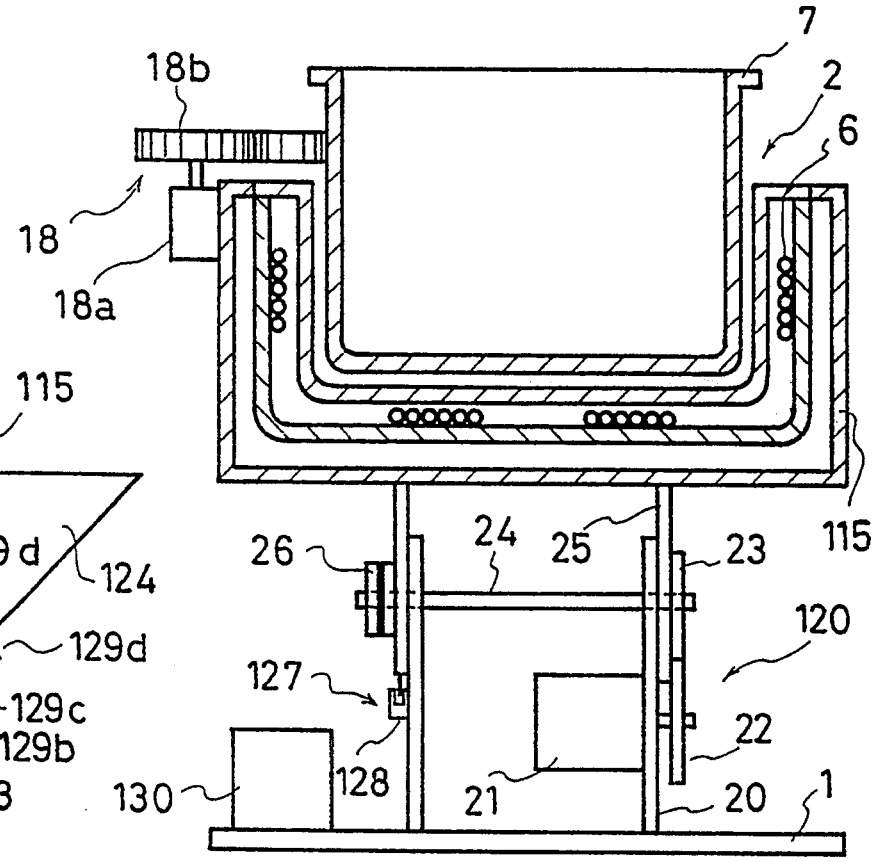
FIG. 5 (*a*) is a diagram showing the side, FIG. 5 (*b*) enlarged diagram showing the angle detection unit, and FIG. 5 (*c*) diagram showing a partial cross-section of the front of an embodiment of a cooker according to the invention.
Figure 5B:
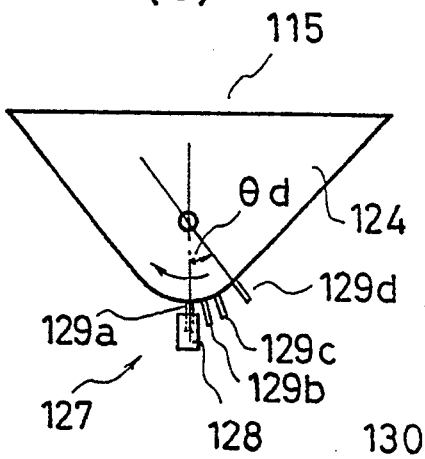
Figure 5C:
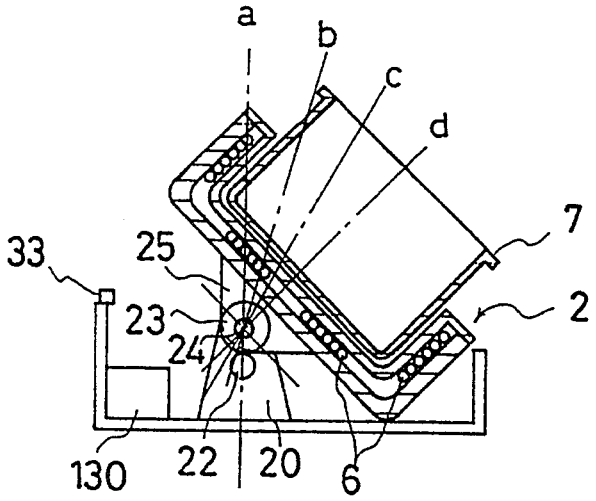
Figure 6:
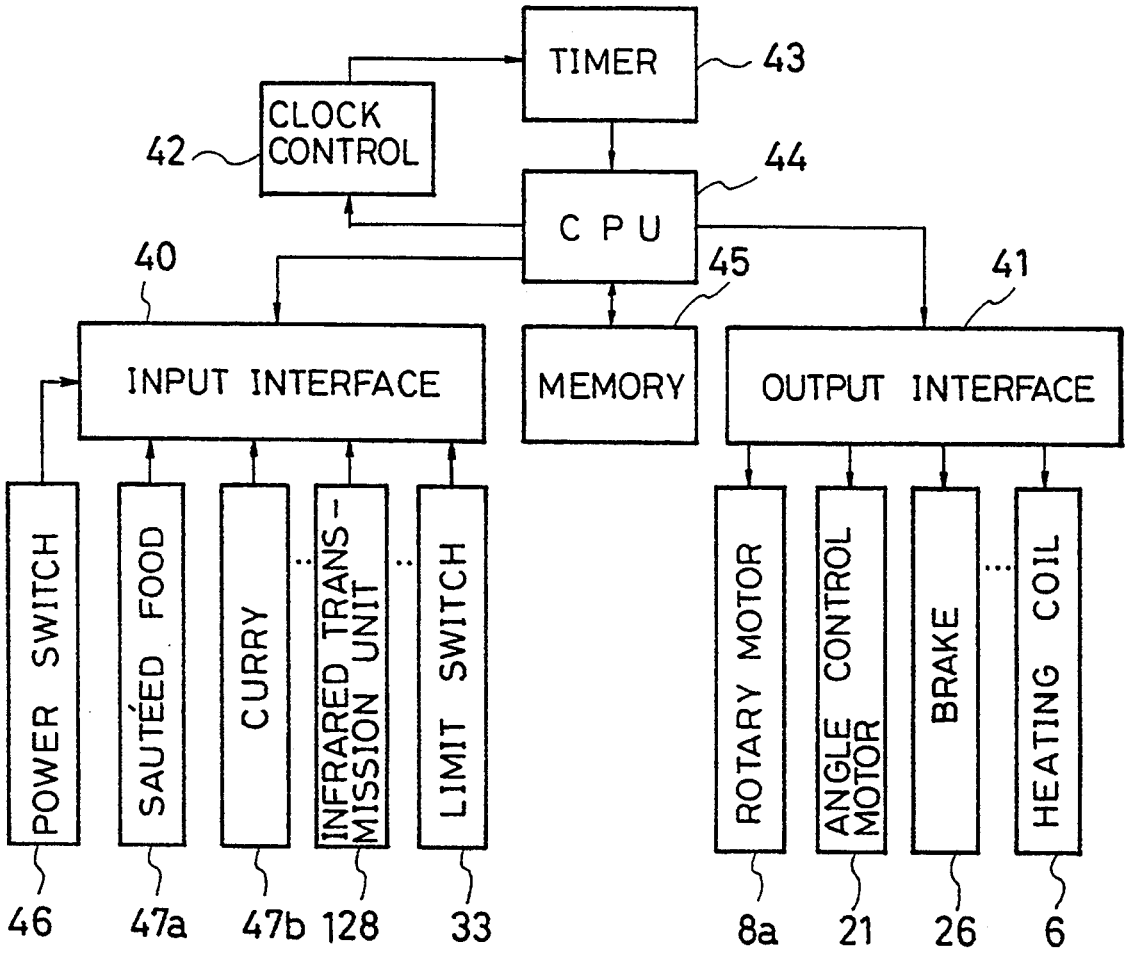
FIG. 6 is a block diagram describing the cooking control configuration.
Figure 7A:
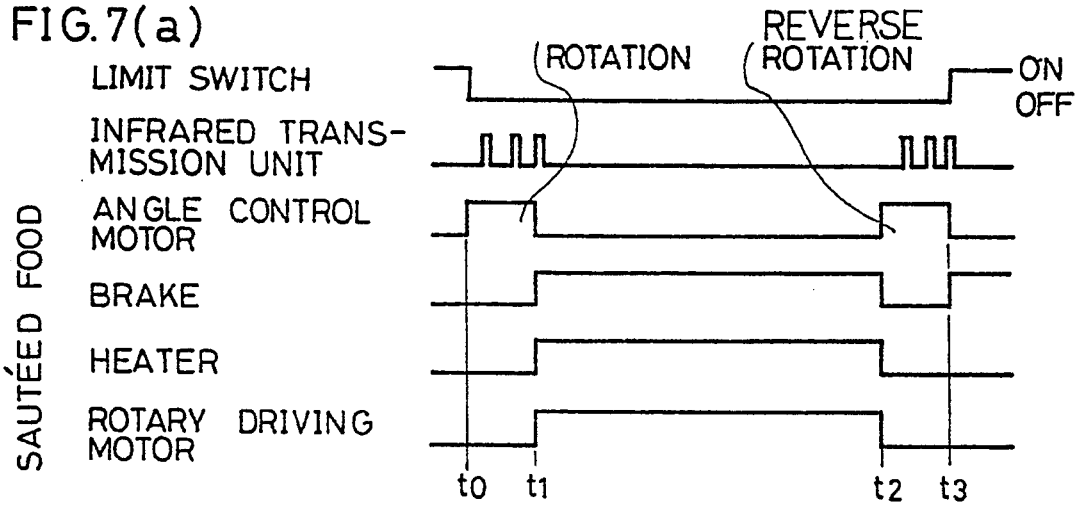
FIG. 7 (*a*), (*b*) and (*c*) are cooking time charts.
Figure 7B:
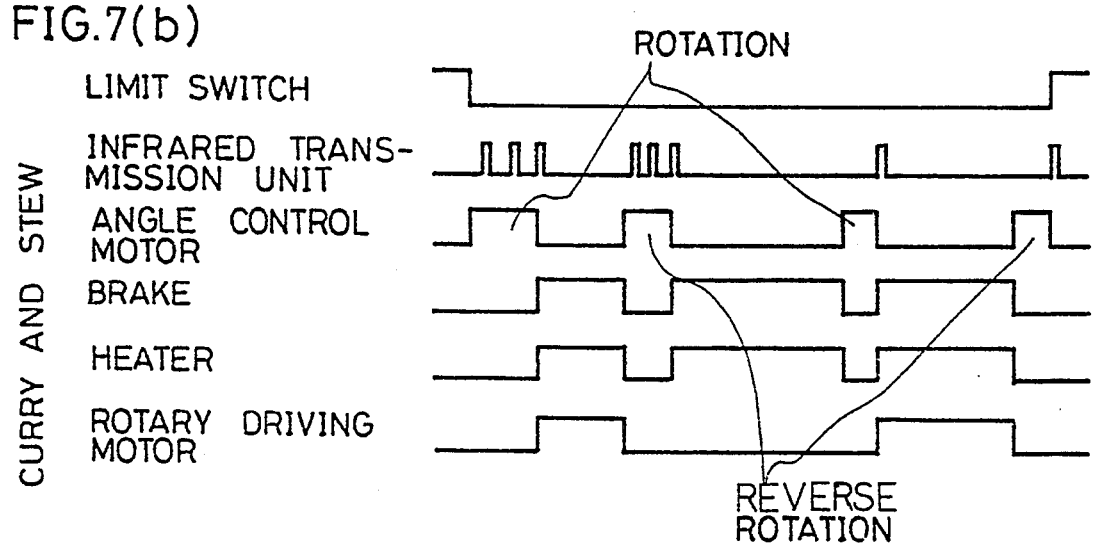
Figure 7C:
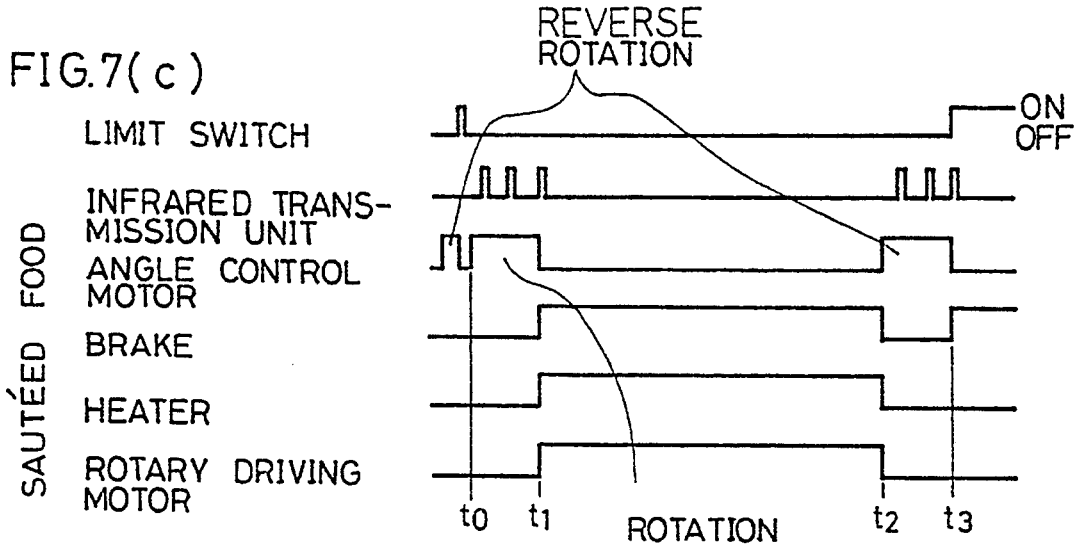

FIG. 5 (*a*) is a diagram illustrating the side of the receptacle inclining unit, (*b*) an enlarged diagram of the angle detection unit, and (*c*) a diagram showing a partial cross-section of the front of a cooker according to the third embodiment. FIG. 6 is a diagram of cooking control configuration. FIG. 7 (*a*), (*b*) and (*c*) are cooking time charts. In these figures, number 2 is a receptacle, 6 heating coil, 7 pot, 18 rotation driving unit, 18*a* motor, 18*b* driving wheel, 115 housing, 120 inclining unit (angle control unit), 21 driving motor, 22 first gear, 23 second gear, 25 bracket, 24 axis, 26 brake, 127 angle detection unit, 128 infrared transmission unit, 129*a* to *d* flange plates, 130 controller, 1 base, 20 support, 33 limit switch, 40 input interface, 41 output interface, 42 clock control unit, 43 timer, 44 CPU, 45 memory, 46 power supply, and 47*a* and *b* cooking course input switches.

As shown in FIG. 5, a rotary cooker according to the present invention incorporates pot 7, rotation driving unit 18 for rotating pot 7, receptacle 2 with heating coil 6 for induction heating cooking pot 7, an inclination angle setting device which is comprised of inclining unit 20 for inclining receptacle 2, brake 26 for maintaining the inclination angle, and inclination angle detection unit 127, and controller 130.

Furthermore, rotation driving unit 18 described above consists of driving motor 18*a* and driving wheels 18*b*, and heating coils are installed inside housing 115. Inclining unit 120 is comprised of driving motor 21 fixed to support 20, first gear 22 coupled with the axis of motor 21 and second gear 23 engaged with first gear 22. Bracket 25 fixed to the bottom of housing 115 is mated with axis 24 so that it can rotate freely. Axis 24 fitted with second gear 23 is fixed to support 20. Therefore, the actuation of motor 21 rotates gears 22 and 23 and bracket 25 simultaneously to incline receptacle 2. In addition, angle detection unit 127 for detecting the angle of receptacle 2 inclined by inclining unit 120 described above consists of infrared transmission unit 128 fixed on support 25 and several flag plates 29*a* to d mounted on bracket 25. Each time flag plates 129 a to d fixed to bracket 115 pass through infrared transmission unit 128 and shade infrared light, output signals are transmitted to controller 130.

Since the inclination angle setting device of receptacle 2 is configured as described above, when the inclination angle of receptacle 2 for cooking is set beforehand and motor 21 is started to incline receptacle 2, angle detection unit 127 operates at the preset angle to stop the operation of motor 21 and start brake 26 in order to maintain the inclination of receptacle 2 at the preset angle. Normally, after the detection of input signals from limit switch 22 at the start of cooking, the angle detection unit detects the preset angle of the receptacle with the number of flags passing by infrared transmission unit 128 so that pot 7 becomes horizontal.

The controller with timer 43 is configured as shown in FIG. 5, and incorporates cooking programs in which cooking procedures are specified for each type of cooking shown in the time charts of FIG. 7. Therefore, when the users of this cooker put ingredients into the pot and select their desired cooking course from courses 47*a* to n for input into input interface 40, ingredients are automatically cooked according to their desired cooking course.

The operation of the cooker in case of the "sauté cours" in FIG. 7(*a*) will be described using the time chart. Ingredients are placed into pot 7 and receptacle 2 is inclined by starting angle control motor 21 at a time of $t_0$. At a time $t_1$ when the inclination angle becomes $\theta d$ (preset inclination angle), angle detection unit 129*d* begins to operate to stop angle control motor 21 and start brake 26 to maintain the angle of the pot at $\theta d$ and heat pot 7 by turning on heating coil 6 while rotating the pot by driving pot rotating motor 18*a*. At a time of $t_2$ when preset time ($t_2$–$t_1$) passes, timer 43 begins to operate to stop the rotation and heating of pot 7. At the same time, the timer releases brake 26 and starts angle control motor 21 to incline receptacle 2 toward the opposite direction. When receptacle 2 returns to the horizontal position, angle detection unit 127*a* operates to start brake 26 to stop receptacle 2 at the original position, thus completing cooking. The controller automatically controls all processes from the inclination of receptacle 2 at the start of cooking to the return to the horizontal position at the end of cooking.

Curry and stew shown in FIG. 7 (*b*) as well as other meals can automatically be prepared with the similar operation of the controller.

FIG. 7 (*a*) and (*b*) are time charts for the operation of each unit at the start of cooking when pot 7 is on horizontal in each cooking course. The operation of each unit will be described using FIG. 7 (*c*) when pot 7 is out of horizontal. FIG. 7 (*c*) is a time chart for the "sauté course" shown in FIG. 7 (*a*) when pot 7 is out of horizontal at the start of cooking. Ingredients are placed into pot 7 and inclining unit 20 is actuated so that pot 7 becomes horizontal until the detection of input signals from limit switch 33. After the detection of input signals from limit switch 33, ingredients are sautéed according to a program shown in FIG. 7 (*a*).

In this embodiment, an infrared sensor is used as angle detection unit 127, but a magnetic sensor can be used instead of the infrared sensor. However, when the magnetic sensor is used, it is recommended not to turn on the heating coils during the angle control of the receptacle, taken into consideration influence on the line of magnetic force by heating coils.

Another method for angle detection is to mount an encoder on axis 24.

Furthermore, the gears shown in the embodiment are not the only angle control means, but ball screws, links and cams can serve this purpose.

According to the invention, a rotary cooker incorporates pot rotation driving means, induction heating means for the pot, and pot inclination angle setting means with an angle detection unit so that the inclination angle of the pot can be automatically selected according to a preset cooking program during cooking. Therefore, cooking is automated by presetting a cooking program according to type of cooking, thus greatly saving cooking time and labor and greatly improving the operational ease of the rotary cooker.

Figure 9:
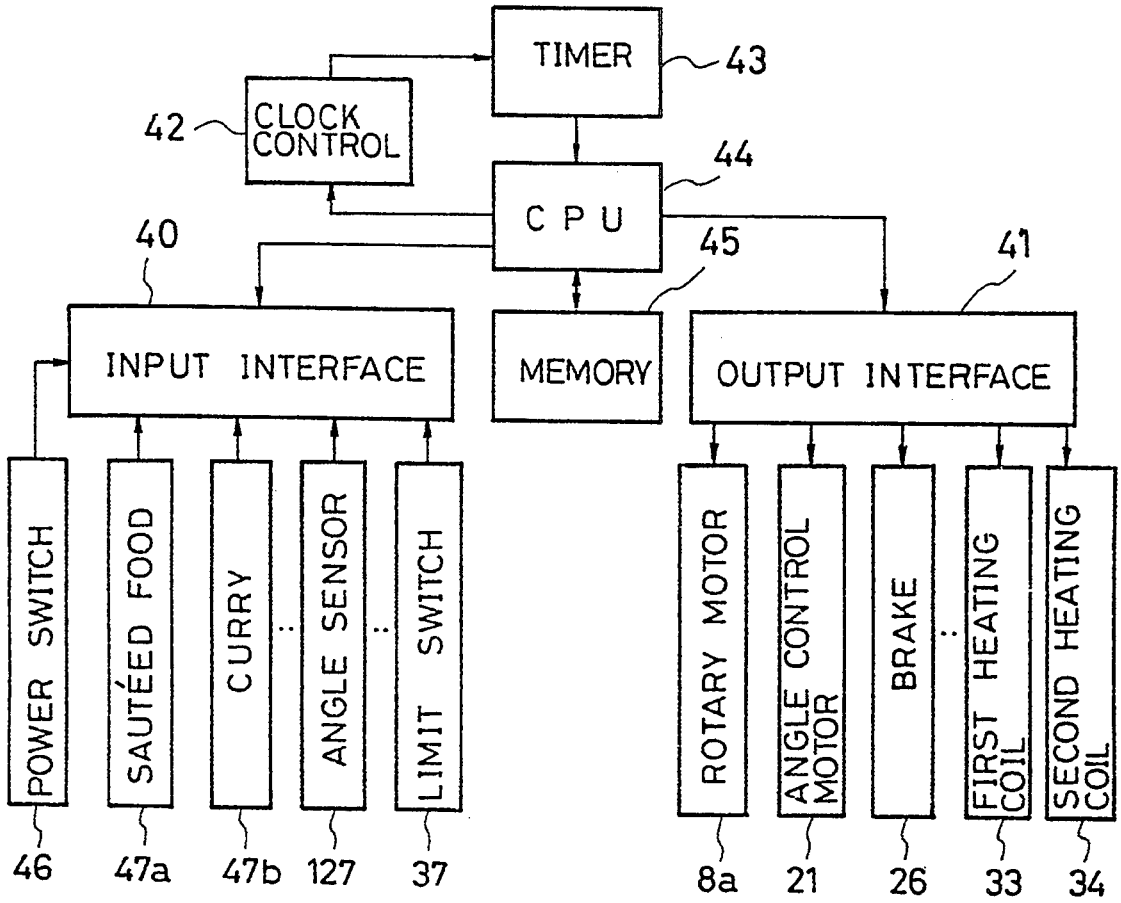
FIG. 9 is a block diagram describing the cooking control configuration.

FIG. 8 (*a*) is a diagram showing the side of a cooker according to the fourth embodiment, FIG. 8 (*b*) an enlarged diagram of an angle detection unit, FIG. 8 (*c*) a diagram showing a partial cross-section of the front of the embodiment. FIG. 9 is a diagram of cooking control configuration, and FIGS. 10 (*a*), (*b*), (*c*) and (*d*) are cooking time charts. In these figures, number 2 is a receptacle, 7 pot, 18 rotation driving unit, 18*a* motor, 18*b* driving wheels, 120 inclining unit (angle control unit), 21 motor, 22 first gear, 23 second gear, 24 axis, 124 bracket, 26 brake, 127 angle detection sensor, 128 infrared transmission unit, 128*a* to *d* flange plates, 130 controller, 1 base, 20 support, 33 first heating coil, 34 second heating coil, 35 first heating coil input control unit, 36 second heating coil input control unit, 37 limit switch, 40 input interface, 41 output interface, 42 clock control unit, 43 timer, 44 CPU, 45 memory, 46 power supply, and 47*a* and *b* cooking course input switches.

As shown in these figures, a rotary cooker according to the present invention incorporates pot 7, rotation driving unit 8 for rotating pot 7, receptacle 2 which consists of first heating coil 33 and second heating coil 34 for induction heating pot 7 and housing 115 for housing these heating coils, an inclination angle setting device comprising inclining unit 120 for inclining receptacle 2, brake 26 and angle detection sensor 127, heating coil input control units 35 and 36 for controlling the inputs of heating coils 33 and 34, respectively, and controller 130.

Since the inclining unit 120 is fitted with motor 21, first gear 22 and second gear 23, when motor 21 is started, bracket 25 fixed on second gear 23 rotates on axis 24 at the same time as gears 22 and 23 rotate. As a result, receptacle 2 fixed on bracket 24 is inclined. Angle detection sensor 127 consists of infrared transmission unit 128 fixed on support 1 and several flag plates 129*a* to *d* mounted on bracket 124. Flag plates 129*a* to *d* mounted on bracket 124 output signals each time they pass through infrared transmission unit 128 to shade infrared rays. When flag plate 129*a* is aligned with infrared transmission unit 128, pot 7 is on horizontal position. The inclination angle of pot 7 becomes larger in the order of flag plates 129*b*, 129*c* and 129*d* which are aligned with the infrared transmission unit. As an example, to incline receptacle 2 at $\theta$d, the cooker is set in such a way that flag plate 129*d* outputs signals when it passes by infrared transmission unit 128. When receptacle 2 is inclined at $\theta$d, motor 21 of the inclining unit stops operation and brake 26 is started to maintain receptacle 2 at $\theta$d.

Normally, a specified angle is detected with the number of flags passing by angle detection sensor 127 after the detection of input signals from limit switch 37 at the start of cooking so that pot 7 becomes horizontal.

Heating coils consist of first heating coil 33 for heating the side of the pot and second heating coil 34 for heating the bottom of the pot, and first heating coil input control unit 35 and second heating coil input control unit 36 are used to control the input of each coil independently.

Figure 10A:
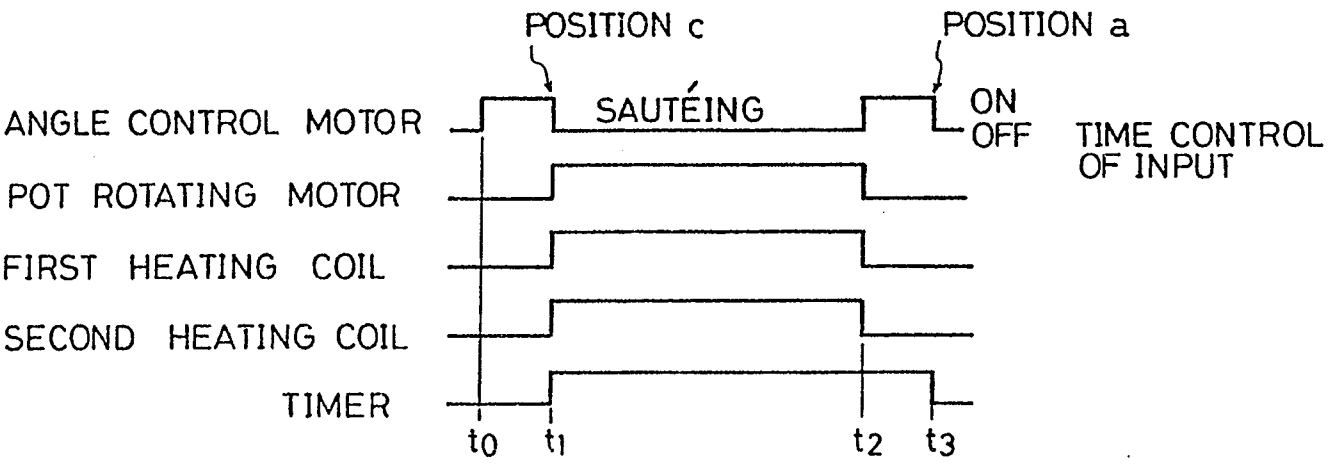
FIGS. 10 (*a*), (*b*), (*c*) and (*d*) are cooking time charts for sautéed, curry and "tempura," respectively.
Figure 10B:
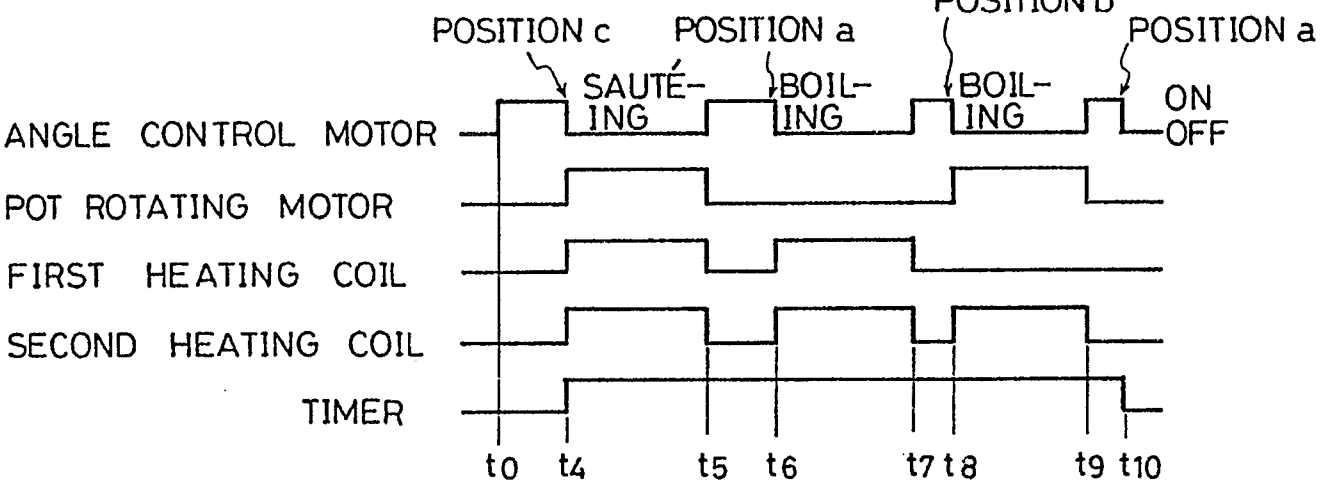
Figures 10C, 10D:
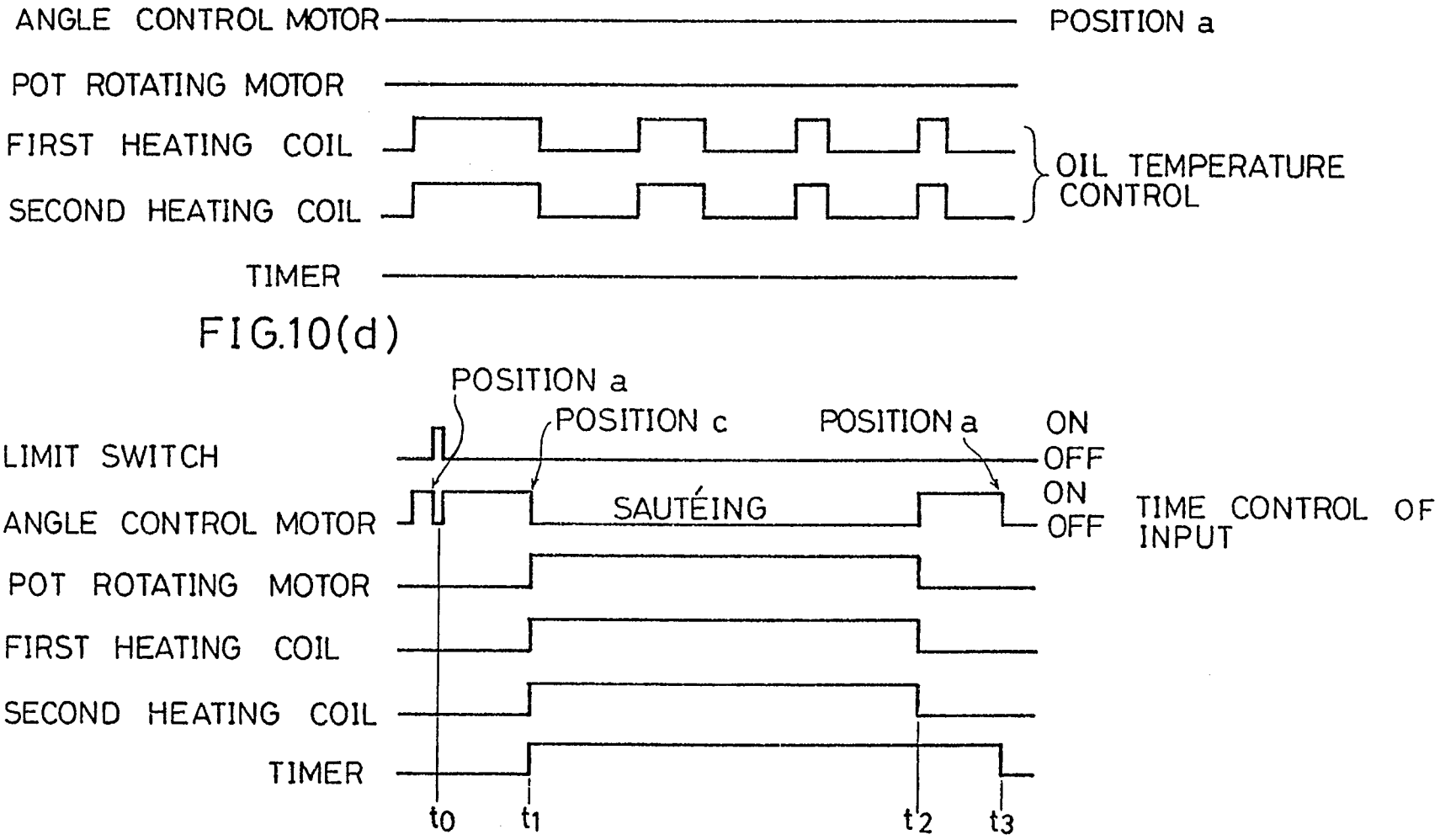

Controller 130 equipped with timer 43 is configured as shown in FIG. 9, and incorporates cooking programs in which cooking procedures shown in the time charts of FIG. 10 are specified for each type of cooking. As described above, the inclination angle and heating method of the pot can be changed, and accordingly, very complicated cooking procedures can be programmed, thus expanding the number of meals to be prepared by the cooker. When users put cooking ingredients into the pot of the cooker and select their desired cooking course from courses 47 *a* to *n* for input into input interface 40, the cooker automatically prepares the desired meals.

The operation of the cooker in case of sautéing course 47*a* shown in FIG. 10 (*a*) will be described using a time chart. Cooking ingredients are put into pot 7 and inclining unit 20 is actuated at a time of $t_o$ to incline receptacle 2. When the receptacle is inclined at a specified angle, angle detection sensor 127 begins to operate to stop angle control motor 21 and start brake 26 at $t_1$ in order to maintain pot 7 at the specified angle. At the same time, timer 43 is started and pot rotation driving unit 18 is activated to rotate the pot, and first and second heating coils 33 and 34 are turned on to heat pot 7 by rotating it. At $t_2$ when specified time ($t_2$–$t_1$) passes, timer 43 operates to stop the rotation and heating of pot 7 and at the same time releases brake 26 to start inclining unit 120 in order to return receptacle 2 to the original position. At $t_3$, when receptacle 2 returns to the horizontal position, angle detection sensor 127 operates to start brake 26 so that receptacle 2 stops at the original position, thus completing cooking. The controller automatically controls all these processes from the inclination of receptacle 2 to the completion of cooking when receptacle 2 returns to the horizontal position.

FIG. 9 (*b*) is a time chart for preparing curry using heating coils 33 and 34. The cooking procedure based on this time chart will be described. Put ingredients into pot 7 and start motor 21 of inclining unit 120 at a time of $t_o$ to incline receptacle 2. At $t_4$ when the inclination of receptacle 2 reaches a specified angle, angle detection sensor 127 operates to output signals to the controller. Then, angle control motor 21 stops operation and brake 26 and timer 43 are started. At the same time, rotation driving motor 18*a* is started to rotate the pot and first and second heating coils 33 and 34 are turned on to heat pot 7, thus starting sautéing ingredients. At $t_5$ when a specified time passes, timer 43 begins to operate and heating coils 33 and 34 and pot rotation motor 18*a* stop operation. At the same time, the angle setting device begins to operate to return the inclination of receptacle 2 to the original angle. At $t_6$when receptacle 2 returns to the horizontal position, angle detection sensor 127 and pot rotation motor 8*a* begin to operate and heating coils 23 and 24 are turned on to heat pot 7 which is on horizontal and does not rotate, thus starting boiling. At $t_7$ when a specified time passes, timer 43 operates to stop heating pot 7 and the angle setting device is actuated to begin inclining receptacle 2. At $t_8$, when the inclination of the receptacle reaches a specified angle, angle detection sensor 127 operates to stop motor 21 of the inclining unit in order to maintain the specified angle. At the same time, the pot is rotated and the second heating coil is turned on to heat the pot from the bottom. At $t_9$ when a specified time passes, timer 43 operates to stop the rotation and heating of pot 7 and inclining unit 120 is also activated to return the inclination of receptacle 2 to the original angle. When receptacle 2 becomes horizontal, angle detection sensor 127 operates to stop the operation of inclining unit 120, thus completing all the operations of the cooker including the timer at t10. In this way, the cooker has two heating coils whose inputs are controlled independently, thus making it possible to set complicated cooking programs and prepare haute cuisine.

With the similar operation of the cooker, it is possible to prepare elaborate meals, but the cooker can also be used to prepare simple meals like "tempura" shown in FIG. 10 (*c*).

FIG. 3 (*a*), (*b*), and (*c*) are time charts for the operation of the cooker in case of each cooking course when pot 7 is on horizontal at the start of cooking. The operation of the cooker will be described when pot 7 is out of horizontal position at the start of cooking, using FIG. 3 (*d*). FIG. 3 (*d*) is a time chart for sautéing course 47 (*a*) shown in FIG. 3 (*a*) when pot 7 is out of horizontal position at the start of cooking. Cooking ingredients are placed into pot 7 and inclining unit 120 is actuated until the detection of input signals from limit switch 37 so that pot 7 becomes horizontal. After the detection of input signals from limit switch 37, a sautéing course carried out according to a program shown in FIG. 3 (*a*).

In this embodiment, an infrared sensor is used as angle detection sensor 27, but a magnetic sensor can be used as an alternative. However, when a magnetic sensor is used, it is recommended not to turn on heating coils during the angle control of the receptacle, taking into consideration influence on the line of magnetic force by heating coils.

Another angle detection method is possible by using an encoder mounted on axis 24.

Furthermore, the gears of the embodiment are not the only inclining unit, but ball screws, links and cams can service this purpose.

According to the invention, a rotary cooker comprises an inclination setting device with an angle detection sensor for inclining a pot, heating means for heating the bottom and side of the pot independently with each input controllable separately, and a controller with a timer. It incorporates cooking programs to be set according to type of cooking and cooks automatically according to the programs. Therefore, it has the following excellent advantages:

(1) Less labor required for cooking even foods of considerable complexity due to automatic cooking.
(2) Failure-free cooking of complicated foods by anyone.
(3) The availability of a wider range of cooking methods.
(4) Greater ease of use of rotary cookers.

Figure 11A:
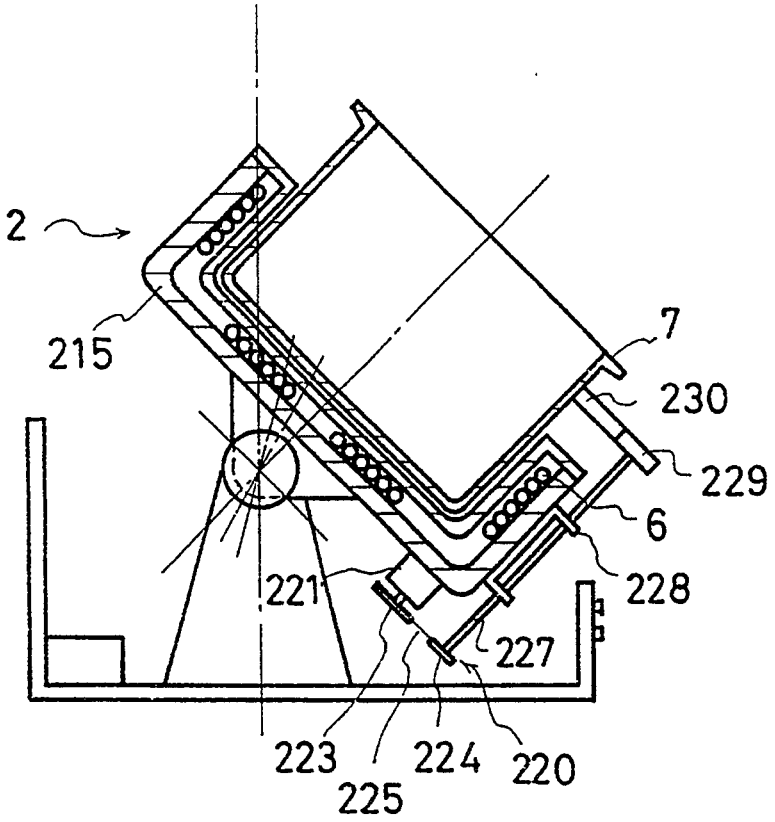
FIG. 11 (*a*) is a diagram showing the front of an embodiment of a cooker according to the invention and FIG. 11 (b) is a diagram illustrating changes in rotation speed.
Figure 11B:
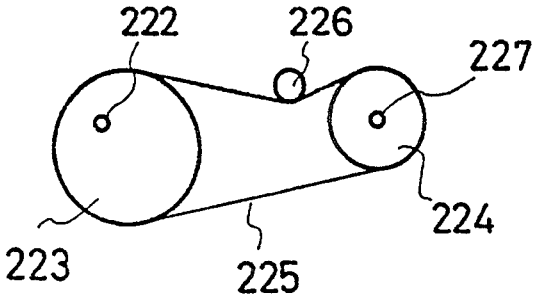

FIG. 11 (*a*) shows the side of an embodiment of a cooker according to the fifth embodiment and FIG. 11 (*b*) is an enlarged diagram of its key part. In the figures, number 2 is a receptacle, 6 heating coil, 7 pot, 215 housing, 220 rotation speed changer, 221 motor, 222 motor axis, 223 eccentric pulley a, 224 eccentric pulley b, 225 belt, 226 tension pulley, 227 driving axis, 228 support frame, and 229 and 230 driving wheels. This embodiment is also equipped with an angle control unit and a controller described in FIG. 33. As shown in the figures, in the rotary cooker according to the invention, rotation speed changer 220 which consists of eccentric pulley a 223 fixed on axis 222 of driving motor 221, pulley b 224, belt 225 for connecting pulleys a and b and tension pulley 226 lies between driving motor 221 and driving axis 227 of driving wheels 229 and 230 for driving the rotation of pot 7.

To cook using this rotary cooker, receptacle 2 with pot 7 and heating coil 6 for heating pot 7 is inclined at a specified angle by an inclining unit (not shown in the figures) and pot 7 is heated by heating coil 6 while being rotated by a rotation driving unit including said rotation speed changer 220.

At this time, when driving motor 221 is started, pulley a 223 is rotated eccentrically as pulley a 223 is fixed on axis 222 eccentrically. As a result, the rotation speed of pulley b 224 changes within one rotation. Therefore, pot 7 rotates while changing its rotation speed within one rotation and accordingly, the rotation of pot 7 becomes irregular, resulting in the complex movement of cooking ingredients within pot 7. In this way, in case of sautéing, the pot can provide excellent cooking performance that cannot be achieved by cooking pots with fixed rotation speed.

Rotation speed changer 220 of this embodiment is not the only means to change rotation speed. Other systems such as activation rate control and phase control can be used to change the rotation speed of motor 221.

According to the invention, a rotary cooker comprises a pot rotation speed changer, and accordingly, the rotation of the pot during sautéing for instance, becomes irregular, resulting in the complex movement of cooking ingredients within the pot and enhanced cooking performance.

Figure 12:
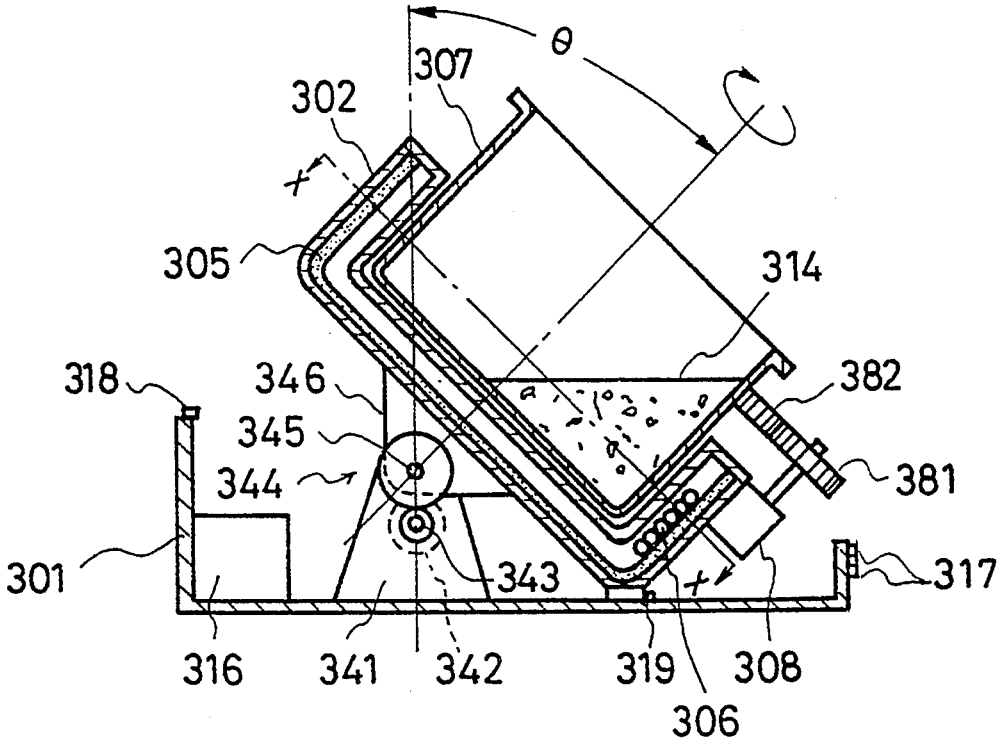
FIG. 12 is a diagram showing the configuration of an embodiment of a cooker according to the invention.
Figure 13:
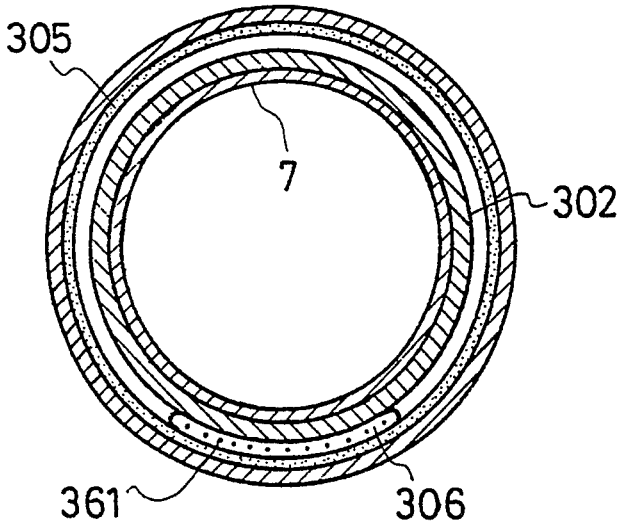
FIG. 13 is a diagram showing a cross-section of X—X of FIG 12.

FIG. 12 is a diagram illustrating the configuration embodiment of an electromagnetic cooker according to the sixth embodiment and FIG. 13 is a diagram showing an X—X cross-section of FIG. 12. The numbers in this figure refer to the same or equivalent parts as those of FIG. 33; however, since the embodiment shown in FIG. 12 is partially different in structure, it will be explained in some detail.

Figure 14:
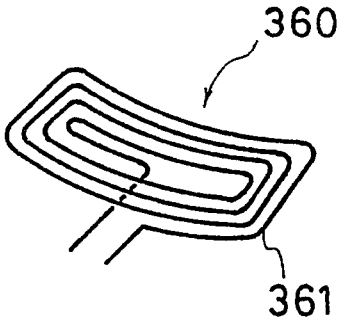
FIG. 14 is an illustration of an induction heating coil.

In FIG. 12, number 301 is a main unit, 302 receptacle, and 307 pot. A non-magnetic material with low thermal conductivity such as ceramics is used in the inside of receptacle 302 and a magnetic material in pot 307. Particularly, an iron-based metal material with high magnetic permeability containing manganese is the best suited for the pot. Number 306 is an induction heating coil installed inside receptacle 302, and 305 heat insulator. A detailed diagram of induction heating coil 306 is omitted, but the coil is made up from a sheathing which covers conductor 361 and a thermal insulator such as mica. As shown in FIG. 14, conductor 361 is coiled like a rectangular spiral to form circular coil 360 and installed inside receptacle 302 for heating the side of inclined pot 307 near the lowest part. Number 308 is a rotary motor, and 381 and 382 rollers. Roller 381 is fixed on rotary motor 308 and roller 382 makes friction contact with the outside of pot 307 and roller 381. 341 is a support fixed on main unit 301, 342 inclining motor, 343 output axis, 344 gears, 345 inclining axis, and 346 bracket. These units including inclining motor 342 constitute an angle control unit described in FIG. 33. Bracket 346 is fixed on the bottom Of receptacle 302 and inclining axis 345 is fitted with a brake not shown in the figure. 314 is ingredients within pot 307, 316 controller, 317 switch, and 318 and 319 limit switches.

The operation of the electromagnetic cooker according to the invention in case of fried rice will be described as an example.

Pot 307 is set in receptacle 302 and switch 317 of controller 316 is turned on. Then, inclining motor 342 is actuated to incline pot 307 at an angle of $\theta$ via output axis 343, gears 344 and inclining axis 345. At both limits of the range of angle $\theta$, limit switches 318 and 319 are activated to protect receptacle 302 and main unit 301 from collision. When an exciting current with a high frequency of 320 to 350 KHz is applied to induction heating coil 306, magnetic flux is generated by the excitation of induction heating coil 306 and an alternating eddy current flows inside pot 307 through receptacle 302 under the influence of electromagnetic induction, thus generating Joule heat. As a result, heat generated through electromagnetic induction begins to spread rapidly from the lowest part of inclined pot 307. Rotary motor 308 is driven to rotate pot 307 with rollers 381 and 382 and at the same time, a proper amount of cooking oil is put into pot 307 and heated by hot pot 307, thus spreading all over the inside of pot 307. After the oil has been properly spread, meat and vegetables are put into the pot. Meat and vegetables are collected in the lowest part of pot 307 and mixed with heated oil. After the meat and vegetables have been sautéed, boiled rice is put into the pot. Afterwards, necessary seasonings and other ingredients are added, and heat and rotation are applied again for a certain time. The rice, meat and vegetables are well mixed and fried rice is done. After cooking, induction heating coil 306 and switch 317 of controller 316 are turned off to stop the rotation and heating of pot 307 which now goes back to the horizontal position. When remaining heat goes away, fried rice is dished up and ready to serve.

Figure 15:
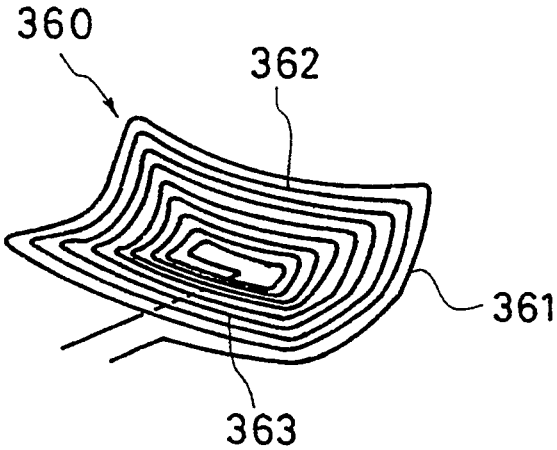
FIG. 15 is a diagram showing the key parts of another embodiment of a cooker according to the invention.

FIG. 15 is a diagram showing key parts of another embodiment of an electromagnetic cooker according to the present invention. In this embodiment, conductor 361 is coiled spirally to form coil 360 which is curved to have two sides 362 and 363 corresponding to the side and bottom of the pot. Induction heating coil 306 made of this coil 360 is very similar in shape to the outline of ingredients 314 collecting between the bottom and the side of inclined pot 307. Therefore, ingredients 314 are heated effectively, thus increasing heating efficiency.

In the above embodiment, pot 307 is rotated by rotary motor 308 in receptacle 302 through friction between rollers 381 and 382. However, the pot can be rotated by driving gears fixed on the sealed rotation axis from the outside. In addition, induction heating coil 306 has only one unit of conductor 361 as shown in the figure, but more than one unit of the conductor can be used as well as more than one unit of coil 360. In the embodiment, pot 307 has no lid. The use of transparent material, such as reinforced glass, for a part or all of pot lid provides the convenience of observing the pot contents as they cook.

The invention relates to an electromagnetic cooker which has an induction heating coil for heating a pot near the lowest part of the inclined pot.

As a result, a part of the inclined pot where ingredients gather is heated concentratedly to the highest temperature.

Therefore, according to the invention, it is possible to provide an economical electromagnetic cooker with a simple configuration which can prepare good meals quickly and has a high heating efficiency.

Figure 16:
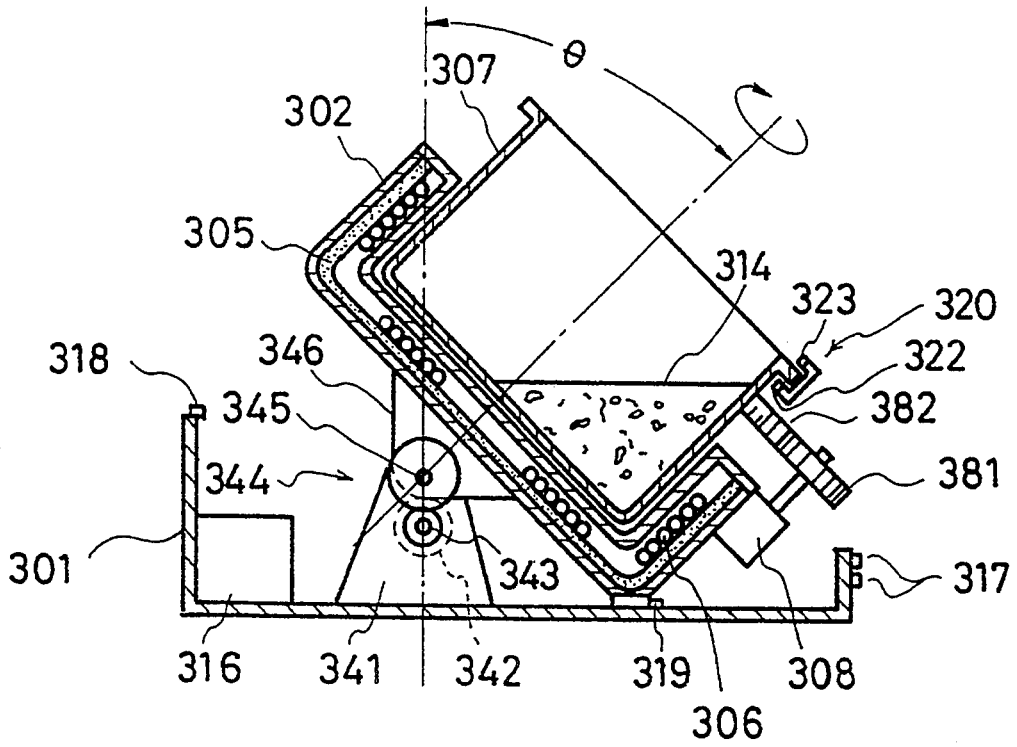
FIG. 16 is a diagram of the configuration of an embodiment of a cooker according to the invention.

FIG. 16 is a diagram illustrating the configuration of an electromagnetic cooker according to the seventh embodiment. The same or corresponding units of the embodiment shown in FIG. 16 have the same numbers as FIG. 33, but other units differ from those shown in FIG. 33 in structure and will be described in details.

In FIG. 16, number 301 is a main unit, 302 receptacle, and 307 pot. A non-magnetic material with low thermal conductivity such as ceramics is used in the inside of receptacle 302. A magnetic material is used in pot 307. Particularly, an iron-based metal material with high magnetic permeability containing manganese is the best suited for the pot. Number 306 is an induction heating coil installed inside receptacle 302, and 305 heat insulator. 308 is a rotary motor and.381 and 382 are rollers. Roller 381 is fixed on rotary motor 308 and roller 382 makes friction contact with roller 81 and the outer periphery of pot 307. 341 is a support fixed on main unit 301, 342 inclining motor, 343 output axis, 344 gears, 345 inclining axis and 346 bracket. These units including inclining motor 342 constitute an angle control unit described in FIG. 33. Bracket 346 is fixed on the bottom of receptacle 302 at one end and inclining axis 345 with a brake not shown in the figure at the other end. 314 is cooking ingredients within pot 307, 316 controller, 317 switch and 318 and 319 limit switches.

Figure 17:
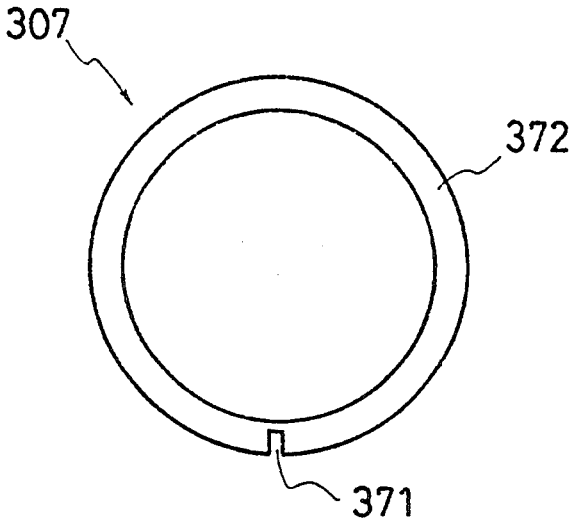
FIG. 17 is a detailed diagram of part of the embodiment shown in FIG. 16.

Number 20 is a position detector for detecting the position of pot 307, and 371 is a cut on flange 372 of pot 307 (FIG. 17). Position detector 320 consists of light emitting device 322 and light detection device 323, for instance, both of which face each other with flange 372 of pot 307 between them, as shown in the figure, The operation of the cooker with this configuration according to this invention will be described in case of fried rice.

Pot 307 is set in receptacle 302 and switch 317 of controller 316 is turned on. Then, inclining motor 324 is actuated to incline pot 307 at an angle of $\theta$ via output axis 343, gears 344 and inclining axis 345. At both limits of the range of angle $\theta$, limit switches 318 and 319 are activated to protect receptacle 302 and main unit 301 from collision. After an exciting current with a high frequency of 320 to 350 KHz is applied to induction heating coil 306, magnetic flux is generated by the excitation of induction heating coil 306 and an alternating eddy current flows inside pot 307 through receptacle 302 under the influence of electromagnetic induction, thus generating Joule heat. As a result, pot 307 begins to be heated by heat generated by electromagnetic induction rapidly. Rotary motor 308 is driven to rotate pot 307 with rollers 381 and 382 and at the same time, a proper amount of cooking oil is put into pot 307 and heated by hot pot 307, thus spreading all over the inside of pot 307. When the oil has been properly spread, meat and vegetables are added. Meat and vegetables are mixed and sautéed by rotation.

Figure 18:
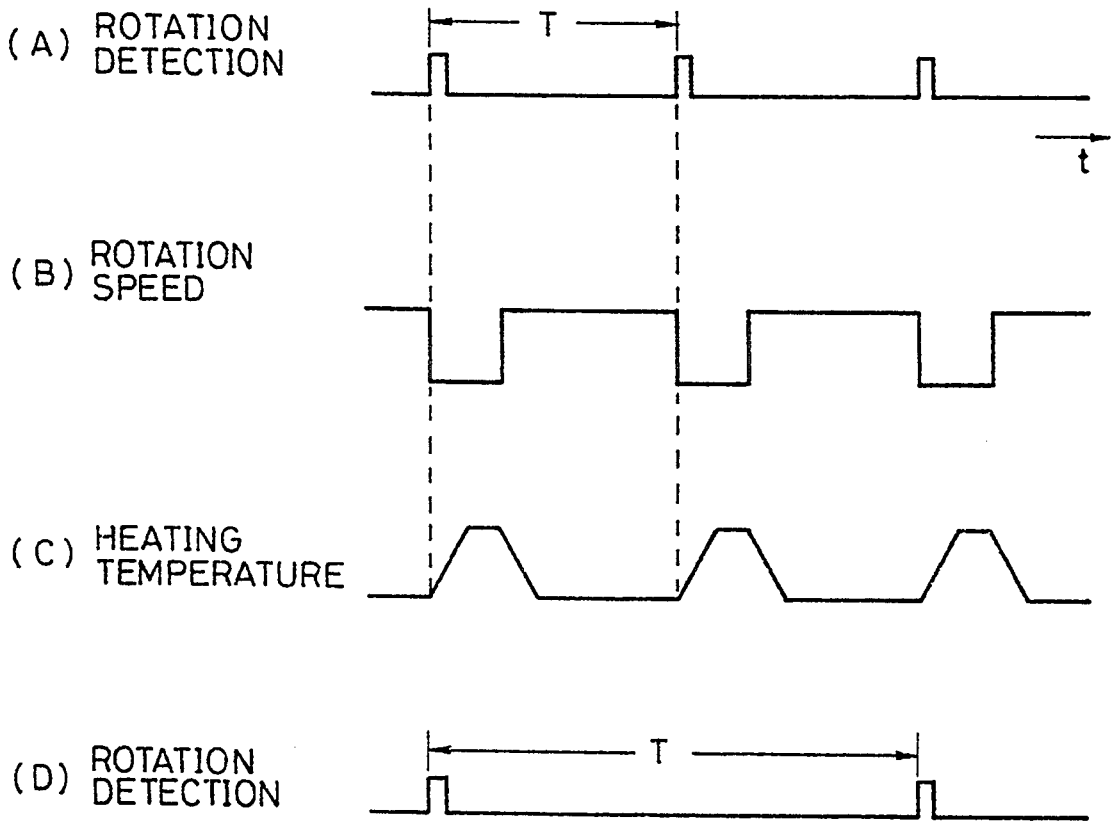
FIG. 18 is a timing chart describing the operation of the present invention.

Meanwhile, when cut 371 comes to position detector 320 by the rotation of pot 307, light emitted from light emitting device 322 18 received by light detecting device 323. As a result, the rotation of pot 307 is stopped by controller 316 via rotary motor 308 and the lowest part of pot 307 is heated concentratedly to high temperatures to heat meat and vegetables which require strong heat. After concentrated heating, the rotation speed returns to the original, and mixing and heating by rotation start again. The operation of the cooker for this type of cooking is shown in the timing charts of FIG. 18 (*a*), (*b*) and (*c*). In FIG. 18 (*d*), detection cycle T is twice as long as that of FIG. 18 (*a*) (once every two rotations). After meat and vegetables have been well sautéed by intermittent concentrated heating, boiled rice is put into the pot. Afterwards, necessary seasonings and other ingredients are added, and concentrated heating by stopping rotation intermittently and mixing/heating by rotation are applied alternately. Then, rice, meat and vegetables are well mixed and fried rice is done. After cooking, induction heating coil 306 and switch 317 of controller 316 are turned off to stop the rotation and heating of pot 307 which now goes back to the horizontal position. When remaining heat goes away, fried rice is dished up and ready to serve.

Figure 19:
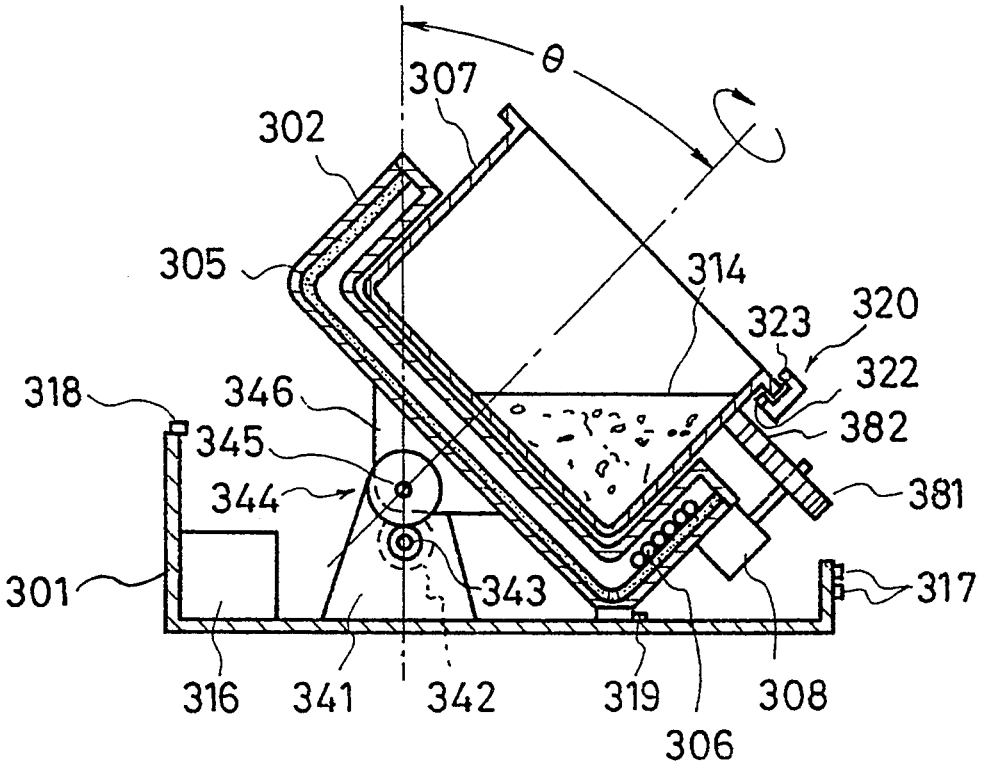
FIG. 19 is a diagram of the configuration of another embodiment of a cooker according to the invention.
Figure 20A:
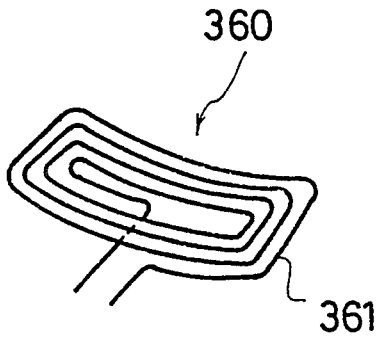
FIGS. 20 (A) and (B) are diagrams of the induction heating coils shown in FIG. 19.
Figure 20B:
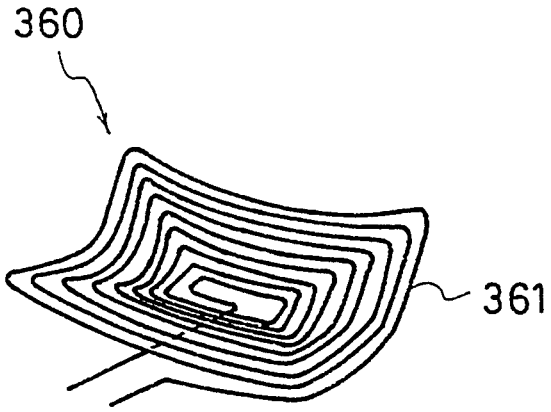

FIG. 19 is a diagram illustrating the configuration of another embodiment of an electromagnetic cooker according to the invention. The embodiment differs from the embodiment shown in FIG. 33 in the structure of induction heating coil 306. A detailed diagram of induction heating coil 306 is omitted, but the coil is made up from a sheathing which covers conductor 361 and a thermal insulator such as mica. Conductor 361, for instance, is coiled like a rectangular spiral to form circular coil 360 as shown in FIG. 20 (*a*). In FIG. 20 (*b*), conductor 361 is used to form bilateral curved coil 360. Induction heating coil 306 made up of coil 360 shown in FIG. 22 (*b*) is very similar in shape to the outline of ingredients 314 collected between the bottom and the side of inclined pot 307. Either coil shown in FIG. 20 (*a*) and (*b*) is installed inside receptacle 302 to heat concentratedly the lowest part of inclined pot 307 and spreads gradually radiat heat all over pot 307. In this embodiment, a part of the pot where ingredients 314 gather is heated concentratedly, resulting in a high thermal efficiency and a small size and low production cost for induction heating coil 306.

In the above embodiment, position detector 320 is used to stop the rotation of pot 307 at a specified position for concentrated heating. A timer can also be used to stop or decelerate the rotation of pot 307, or users can operate manually for concentrated heating while looking at cooking proceeding. In this embodiment, pot 307 has no lid, but the use of transparent material such as reinforced glass for a part or all of the pot lid provides the convenience of observing the pot contents as they cook.

This embodiment relates to an electromagnetic cooker which changes contact time between ingredients and a heated cooking pot regularly or at random through the control of the rotation of the pot. As a result, mixing/heating by rotation and concentrated heating by stopping or decelerating the rotation are combined to sauté food efficiently. Particularly, when induction heating coils for induction heating the pot are installed at the side of the lowest part and the corner of the inclined pot, a part of the inclined and rotated pot where ingredients gather is heated concentratedly to the highest temperature, thus further increasing a thermal efficiency.

Therefore, the cooker can cook vegetables with fresh colors as well as good meat.

Therefore, according to the invention, it is possible to provide an economical electromagnetic cooker with a simple configuration which can prepare good meals quickly and has a high thermal efficiency.

Figure 21:
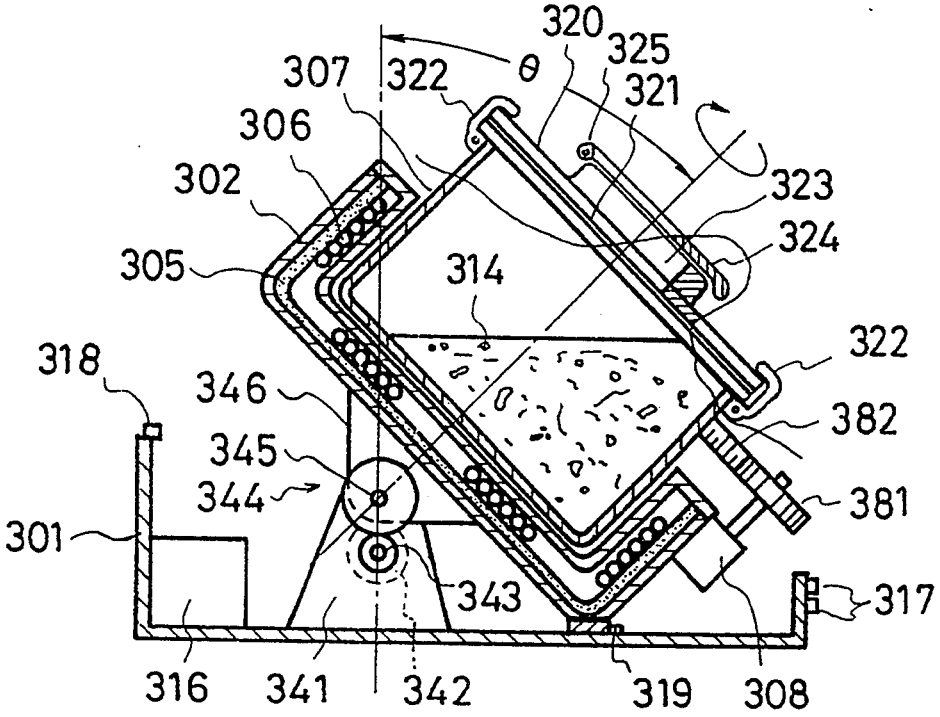
FIG. 21 is a diagram of the configuration of the embodiment according to the invention.

FIG. 21 is a cooker according to the eighth embodiment. The numbers in this figure refer to the same or equivalent parts as those of FIG. 33; however, since FIG. 21 is partially different in structure, it will be explained in some detail.

In FIG. 21, 301 is the main unit and baseplate, 302 receptacle, and 307 cooking pot. A non-magnetic material with low thermal conductivity, such as ceramic, is used for the inner surface of receptacle 302, while magnetic material is used for the inner surface of cooking pot 307, with iron-based metal with high magnetic permeability being especially suitable. Number 306 is an induction heating coil built into the cooking pot 302, 305 heat insulator, 308 rotary motor, and 381 and 382 rollers. Roller 381 is built into rotary motor 308, and roller 382 makes friction contact with the outside of cooking pot 307 and roller 381. Number 341 is a support that is fixed to main unit 301, 342 inclining motor, 343 output axis, 344 gears, 345 inclining axis, and 346 bracket. Bracket 346 is fixed to the bottom of receptacle 302 and to inclining axis 345 which is provided with a brake that is not shown. Number 314 is ingredients within cooking pot 307, 316 control unit, 317 switch, and 318 and 319 limit switches.

Number 320 is a pot lid, 321 packing, and 322 clasp. Number 323 is a port built-into the center of pot lid 320, 324 port cover, and 325 hinge. Rotating cover 324 with hinge 325 acting as a fulcrum opens and closes port 323. As shown in the figure, when cover 324 is placed over port 323, the free moving part of cover 324 lies flush with the outer rim of port 323 to provide tight closure.

The cooking procedures for a cooking pot according to the invention and in this configuration will now be explained. Pot lid 320 is placed onto cooking pot 307 and closed with clasp 322, and the cooking pot is placed into receptacle 302. After cooking pot 307 is in place, switch 317 of the control unit is turned on to activate inclining motor 342, and cooking pot 307 is inclined to an angle of $\theta$ through output axis 343, gears 344, and inclining axis 345. These parts including inclining motor 342 constitute the angle control unit explained in FIG. 33. Limit switch 318 or 319 is activated at each limit of the range of angle $\theta$ to protects receptacle 302 and other parts from collision. shown in FIG. 3 (*a*) when pot 7 is out of horizontal position at the When a current with a high frequency of about 20–50 KHz is applied to induction heating coil 306, alternating eddy currents are generated through electromagetic induction via receptacle 302, to produce joule heat inside cooking pot 307 which lies within the magnetic field. As a result, the heat produced through electromagnetic induction begins heating up cooking pot 307 at a high rate. When cooking pot 307 has heated up, pot lid 324 is rotated on hinge 325, which acts as a fulcrum, to provide access to the cooking pot, and a proper amount of cooking oil is added through port 323. Rotary motor 308 is activated and cooking pot 307 is rotated via rollers 381 and 382, and the oil is spread within cooking pot 307. After the oil has been properly spread, port 323 is opened again and meat or vegetables are added. Afterwards, previously prepared rice and seasonings are added through port 323 in the same way, and heat and rotation are applied again for a certain length of time. The rice and ingredients are well mixed and cooked. After cooking has been completed, induction heating coil 306 and switch 317 of control unit 316 are turned off. The rotation and heating of cooking pot 307 are stopped, and cooking pot 307 returns to horizontal position. After sufficient cooling has occurred, the prepared fried rice can be served. After the meal, cooking pot 307 and pot lid 320 are washed separately.

In the above embodiment, cooking pot 307 is inclined by inclining axis 345 on top of support 341 and rotated by roller 382 by friction. However, means for inclination and rotation are not limited to those of this embodiment. Furthermore, although not included in the above explanation, the use of transparent material, such as reinforced glass, for a part or all of pot lid 320 provides the convenience of observing the pot contents as they cook. Also, cooking pot 307 was placed in receptacle 302; however, other suitable means of mounting the cooking pot may also be used.

This invention relates to an electromagnetic cooker with a pot lid that is provided with a port. When the pot and pot lid are set into the mounting apparatus, they are rotated as the entire assembly is inclined. For this reason, it maintains an airtight seal of the contents and eliminates the wear that usually takes place at the point of contact between the cooking pot and the lid through friction. Since ingredients and seasonings are added through the port into the cooking pot, spilling out of contents is minimized. Moreover, not only can the cooking pot be taken out for cleaning, it can also be used as an ordinary cooking pot with a lid.

The above characteristics make it possible to provide an electromagnetic cooker that is high in sanitation and applicability, as well as easy to use.

Figure 22:
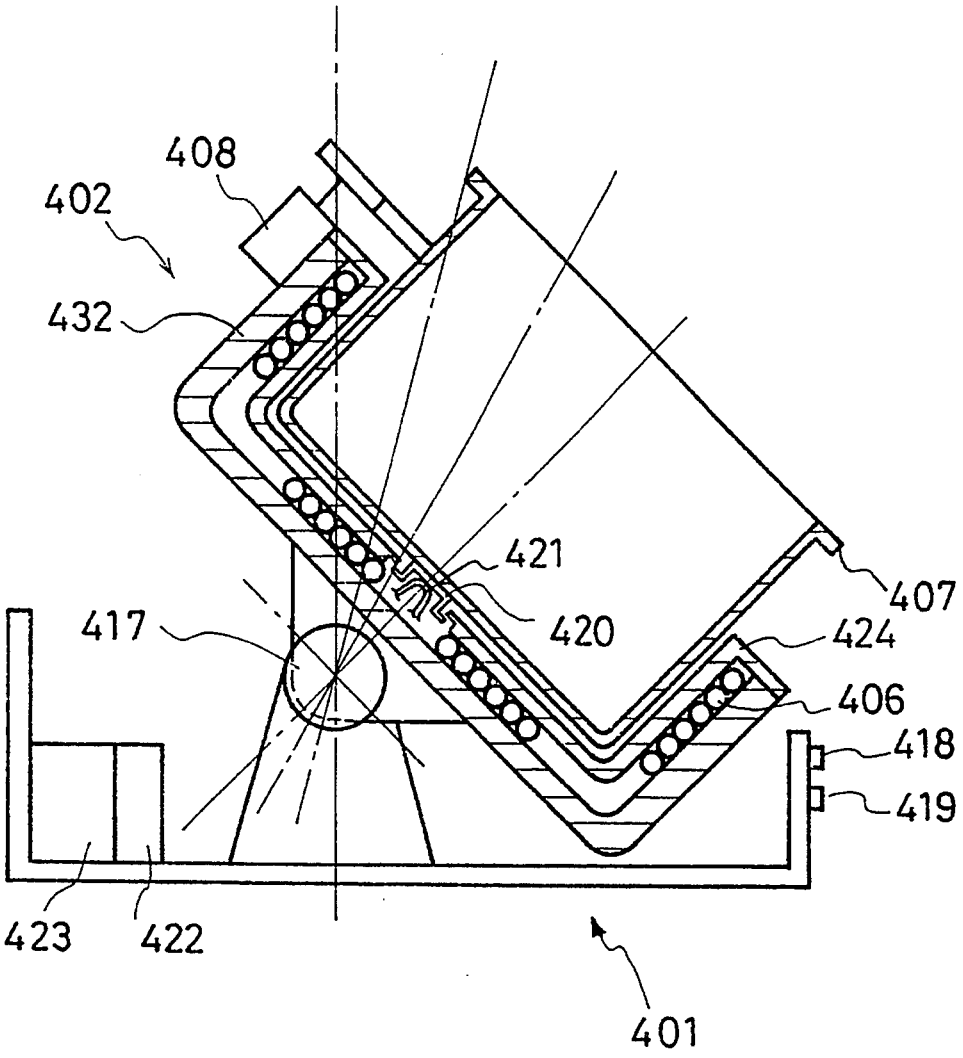
FIG. 22 is a diagram showing a cross-section of the side of the embodiment according to the invention.
Figure 23:
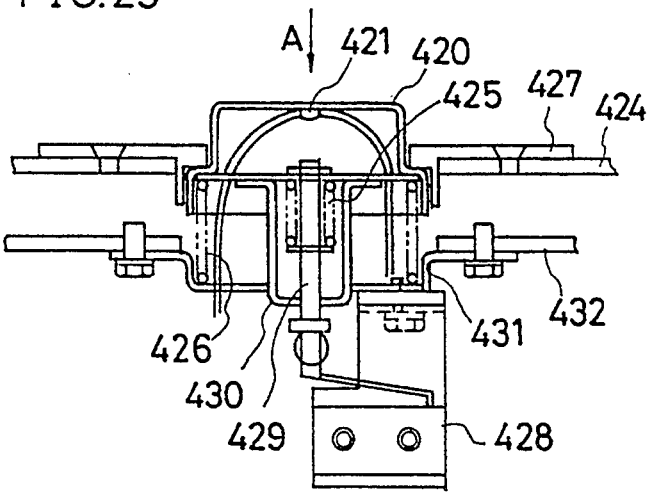
FIG. 23 is a diagram showing a cross-section of key parts of the embodiment.
Figure 24:
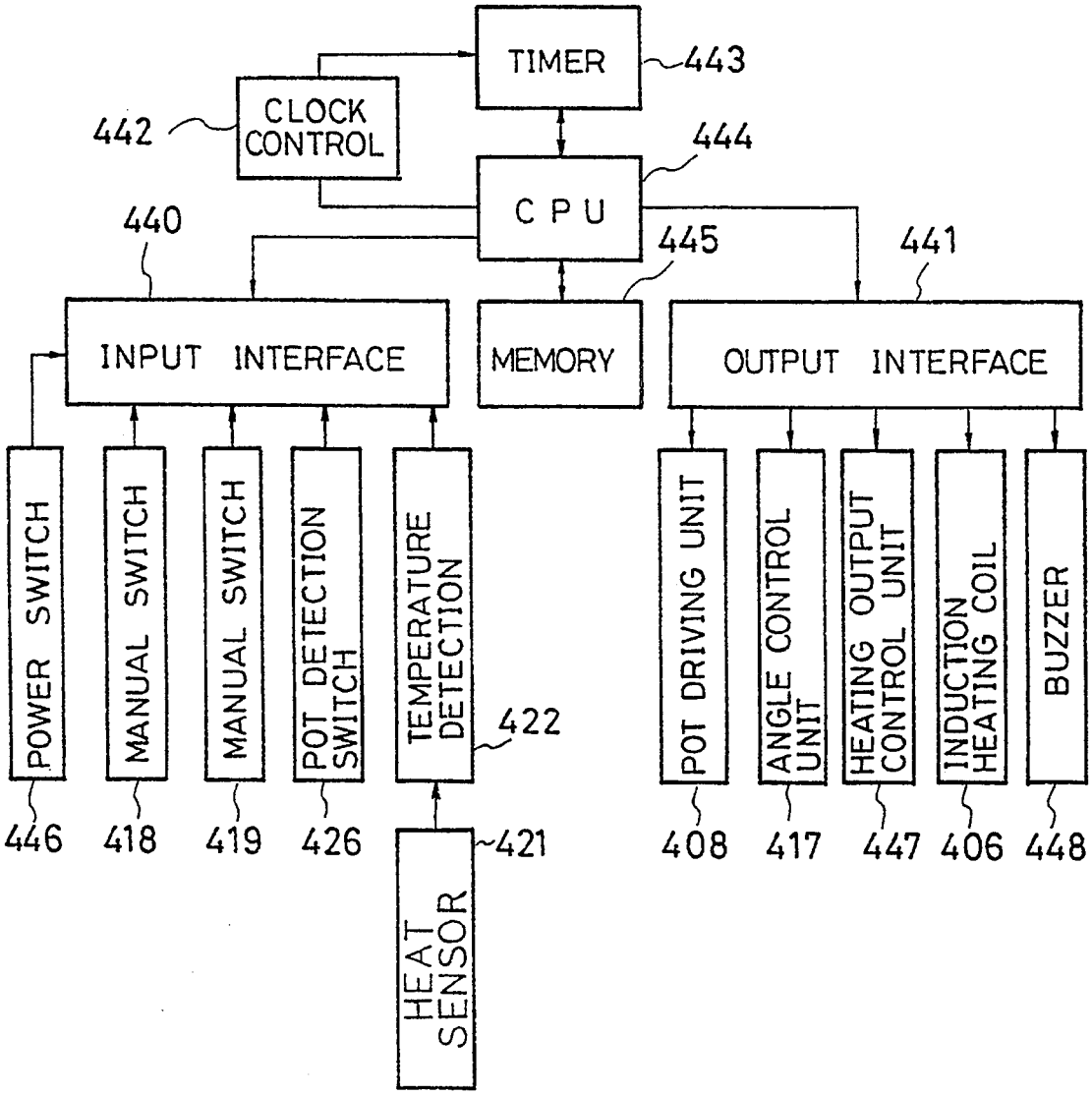
FIG. 24 is a diagram describing the configuration of a controller.

FIG. 22 shows a cross-section, FIG. 23 a partial cross-section of the key parts, and FIG. 24 a diagram showing the configuration of the controller of a cooker according to the ninth embodiment.

In FIG. 22, 401 is the base, 402 the main unit of the rotary cooker, 406 induction heating coil, and 407 cooking pot. Cooking pot 407 can be detached from main unit 402. Number 408 is a pot driving unit, 417 angle control unit for changing the inclination angle of main unit 402 and cooking pot 407. Numbers 418 and 419 are manual switches built into base 401 for selecting the type of food and the inclination angle of the pot and other conditions. These consist of, for example, a number of switches arranged in a horizontal row. Switch 418 is for selecting such cooking courses as "curry" and "sauté," while manual switch 419 is used to select such cooking conditions as the inclination angle of cooking pot 407, the rotation speed, and the heat output. Number 420 is a contact that touches the bottom of cooking pot 407 and 421 heat sensor built inside contact 420. A non-magnetic metal with high thermal conductivity, such as aluminum, would be suitable for contact 420.

An enlarged view of the surrounding configuration of contact 420 is shown in FIG. 23. (The following refers to FIG. 23.) Number 424 is a pot base which receives cooking pot 407, 425 and 426 springs, 427 stopper that is attached to base 424. Contact 420 is pressed upward by spring 426, and is held down at the top by stopper 427. Number 428 is a pot detection switch which detects the presence of the pot, 429 pin which presses down pot detection switch 428 via spring 425, 430 guide that slides up and down pin 429, and 431 a guide base for guide 430. Number 432 is a coil base for fixing induction heating coil 406, 422 a thermometer (FIG. 22) for measuring the temperature of cooking pot 407 through heat sensor 421, and 423 control unit for controlling pot driving unit 408, inclination angle control unit 417 and the heat output of induction heat coil 406 through the the output of thermometer 422.

Number 440 in FIG. 24 is an input interface, 441 output interface, 442 clock control unit, 443 timer, 444 CPU, 445 memory, 446 power switch, 447 heat output control, and 448 buzzer.

In the case of a rotary cooker of the structure described above, power switch 446 is turned on and cooking pot 407 is placed into main unit 402. After ingredients are placed into cooking pot 407, cooking is begun at the desired inclination angle, rotation speed, heat output of induction heat coil 406, and other cooking conditions that are set through manual switch 419.

When cooking pot 407 is placed into main unit 402, contact 420 is pressed downward by the weight of cooking pot 407 in the direction indicated by arrow A, and maintains the cooking pot at a horizontal position higher than pot base 424. At this time, the spring pressure of springs 425 and 426 places contact 420 into contact with the bottom of cooking pot 407, causing contact 420 and cooking pot 407 to be thermally joined. At the same time, pin 429 follows the downward movement of contact 420, and guided by guide 430, presses against pot detection switch 428, by which the presence of cooking pot 407 on top of main unit 402 is detected. In reverse, when cooking pot 407 is removed, pin 429 springs upward to release pot detection switch 428, and the "absence" of cooking pot 407 is detected.

Figure 25:
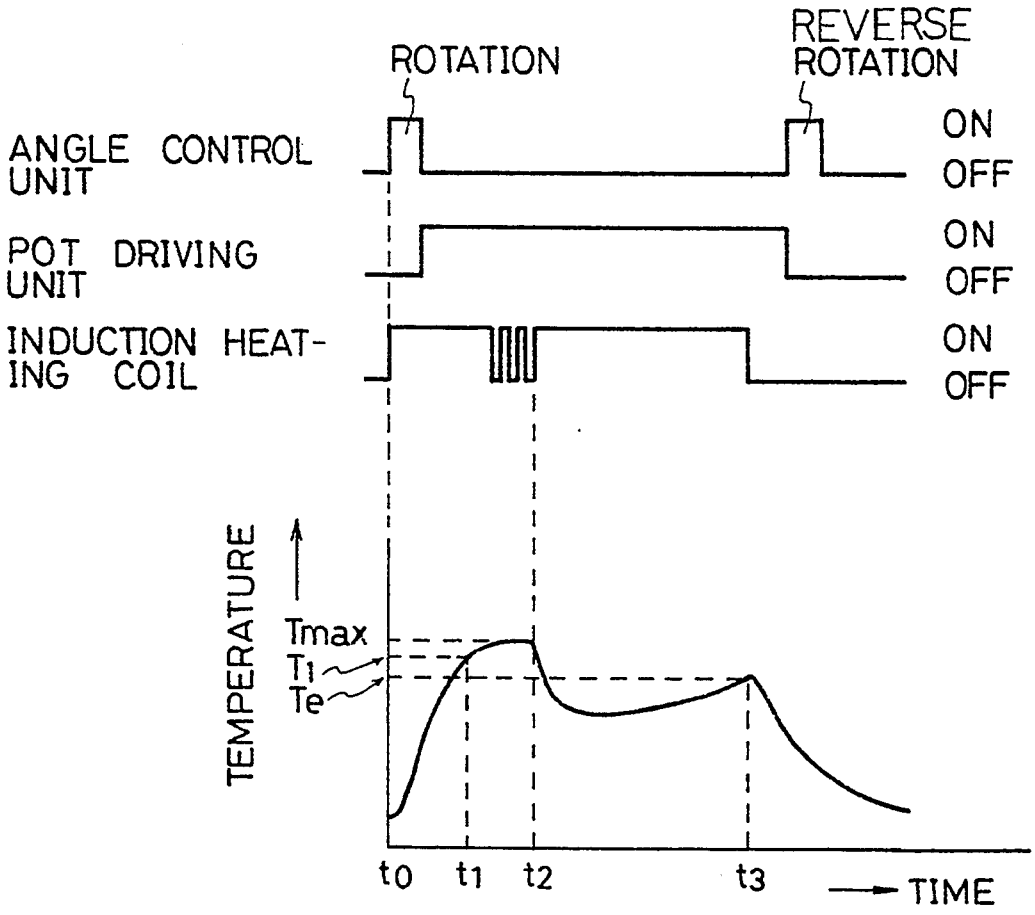
FIG. 25 is a sautéing timing chart.

Controller 423, which is provided with CPU 444 and whose configuration is shown in FIG. 24, incorporates programs of cooking conditions for various cooking procedures in the form of time charts such as that used in the example in FIG. 25 for a "sauté course."As a result, after putting ingredients into cooking pot 407 and inputting the desired cooking course into input interface 440 through manual switch 418, the desired cooking is done automatically.

The action of the rotary cooker in the case of the "sauté course" in FIG. 25 will be explained next on the basis of the time chart and the changes in the temperature of contact 420. After cooking pot 407 is placed into main unit 402 and cooking is started with the cooking time set at t0, angle control unit 417 changes the angle of main unit 402 and induction heat coil 406 is activated through heat output control 447. When the inclination angle of main unit 402 reaches a certain angle, the operation of angle control unit 417 stops and pot driving unit 408 begins and cooking pot 407 starts rotating. After cooking has started, heat sensor 421 within contact 420 monitors the temperature of cooking pot 407 as it is heated by induction heat coil 406. When a time of tO–t1 has elapsed and the temperature becomes T1 proper to add oil in the pot, buzzer 448 sounds to instruct the user to add oil. After the oil is added, control unit 423 adjusts the current to induction heating coil 406 so that temperature Tmax is not exceeded if a certain amount of time passes while the ingredients have not been added. After ingredients are added to cooking pot 407 at time t2, the temperature measurment of heat sensor 421, which had dropped, begins to rise again. When the temperature rises to Te (at a time t3), the cooking of the ingredients is completed and current to induction heating coil 406 is cut. After the current is cut, cooking pot 407 maintains a relatively high temperature. To prevent the cooked ingredients from burning, pot driving unit 408 continues the rotating action, mixing the ingredients for a little while even after current to induction heat coil 406 is shut off. After a certain duration or when cooking pot 407 cools down to a certain temperature, pot driving unit 408 stops. Angle control unit 417 restores the horizontal position and the "sauté course" is ended. All cooking operations, from inclination angle of main unit 402 at the start of cooking to the return to the horizontal position at the end of cooking are controlled automatically by controller 423.

In addition, after ingredients are added, pot driving unit 408 may be controlled in such a way that allows the rotation of cooking pot 407 to be modified through controller 423.

As shown in FIG. 25, controller 423 controls the temperature in such a way that Tmax is not exceeded by adjusting the input to induction heating coil 406 during the period from t1 to t2, thus preventing the occurrence of abnormally high temperatures in pot 407. Furthermore, a maximum time of from t1 to t2 may be set, and the activation time of induction heating coil 406 may be automatically cut off when the maximum time is reached. This type of configuration would prevent burning of the ingredients or damage to cooking pot 407 by overheating, scorching caused by activation of induction heating coil 406 for long periods, or the occurrence of fire.

It is also possible through controller 423 to automatically control the temperature of cooking pot 407 so that it does not exceed Tmax even when heat output has been adjusted manually by manual switch 419.

In the above embodiment, contact 420 is fixed to main unit 402. However, it is also possible to use metal balls or metal rollers, etc. which are high in thermal conductivity and resistant to wear In contact 420. In addition, contact 420 which contains heat sensor 421 can be attached to main unit 402 in such a way that allows it to be rotated and put in flexible contact at approximately the center of the bottom of cooking pot 407 to allow temperature measurements at the point of contact. In a cooker with contact 420 in the configuration described in the two embodiments above, the point of contact between contact 420 and cooking pot 407 would be free of wear and higher in thermal linkage. Moreover, though the embodiment described cooking pot 407 without a lid, the use of a lid made of transparent material such as reinforced glass for a part or all of pot lid would allow the user to view the contents of the pot during cooking for greater convenience.

As described in the above explanation, the following features of the invention constitute a rotary cooker that has: (1) means of detecting the temperature of the cooking pot through the use of a heat sensor that is thermally linked with the cooking pot; (2) means of controlling the cooking conditions such as pot driving means, pot heating means, and angle control means based on the output from the means of temperature detection; and (3) programs based on cooking conditions for specific foods that have been stored in memory to allow the automatic preparation of those foods through operation of the programs. From this, the following results may be expected:

(1) Less labor required for cooking even foods of considerable complexity due to automatic cooking.
(2) Failure-free cooking of complicated foods by anyone.
(3) The availability of a wider range of cooking methods.
(4) Greater ease of use of rotary cookers.

The placement of a contact at the center of the cooking pot's rotation greatly minimizes the effects of friction, etc. Such effects would be reduced even more by enabling the contact to the main unit to be rotated by using, for example, metal balls. This would have the added benefit of enhanced thermal linkage for higher accuracy in temperature measurements.

For these reasons, this invention would make possible the provision of a rotary cooker with features such as those listed above in (1) to (4).

Figure 26:
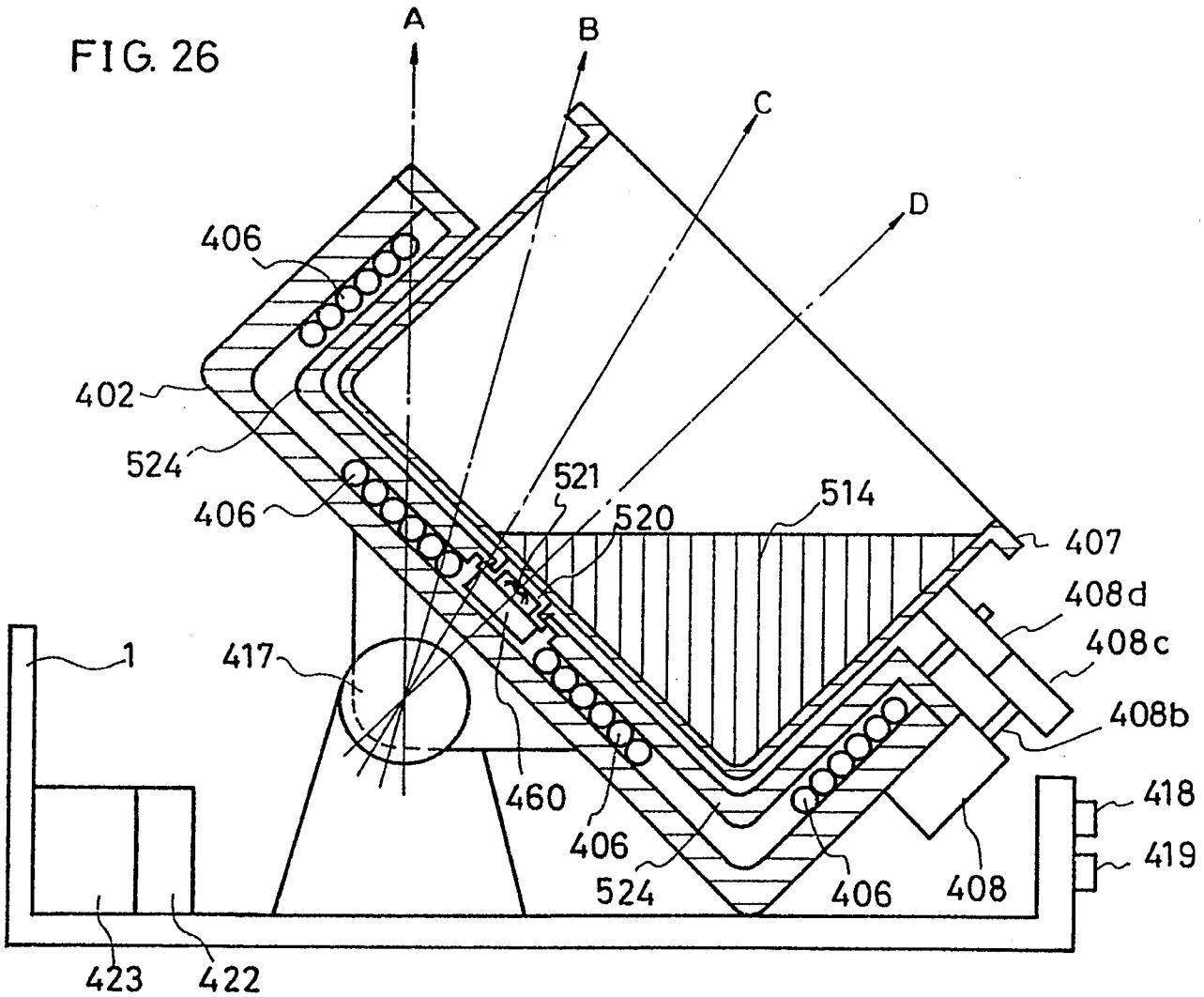
FIG. 26 is a diagram showing a cross-section of the embodiment of a cooker according to the invention.

An embodiment of a cooker according to the tenth embodiment is explained below referring to figures. FIG. 26 is a cross-section of a cooker according to the tenth embodiment. Numbers in the figure which are the same as those in FIG. 33 refer to the same or equivalent parts. Number 417 is an angle control unit which changes the angle of receptacle 402 in the angles indicated by arrows A to D via action of such parts as motor and gear that are not represented in the figure, 418 switch for selecting such cooking courses as "sauté" or "curry," 419 manual switches operated by the user to select such cooking conditions as pot inclination angle, pot rotation speed, and heat output, 520 contact, 521 heat sensor contained within contact 520, 460 moving means for bringing contact 520 into or out of contact with the outside of cooking pot 407, 422 temperature measuring circuit for measuring the temperature picked up by heat sensor 521, 423 means of control, 524 pot base for mounting cooking pot 407, and **408*c* and 408*d* rollers for transferring the rotational driving force of pot driving means 408 to cooking pot 407**.

Figure 27:
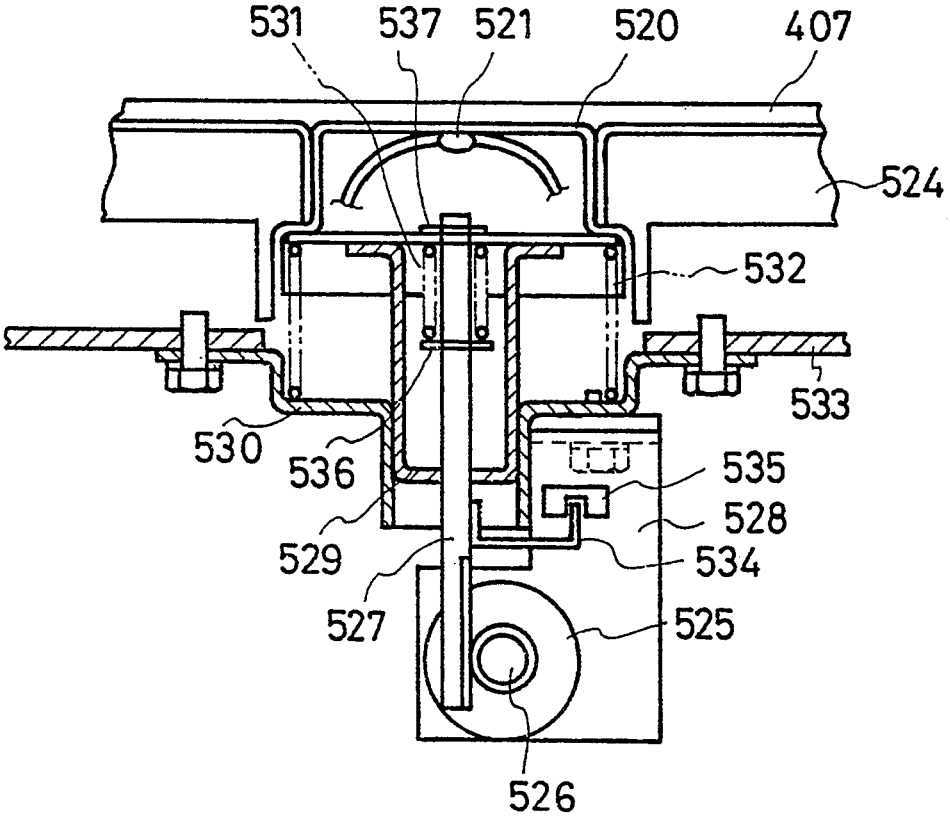
FIG. 27 is a diagram of a cross-section of driving means (60) shown in FIG. 26.

FIG. 27 is a cross-section of driving means 460 of FIG. 26. In the figure, 525 is a driving motor that moves contact 520 up and down, 526 gear attached to the axis of driving motor 525, 527 shaft that holds the rack fixed to contact 520 which meshes with gear 526, 536 and 537 rings attached to shaft 527, 534 flag fixed to shaft 527, 535 sensor that detects the position of flag 534, 528 motor base that fixes driving motor 525, 529 guide that slides up and down shaft 527, 530 guide base for receiving guide 529, 531 adjustment spring that corrects the positional relationship between shaft 527 and contact 520, 532 pressure spring that presses contact 520 against the bottom of cooking pot 407, and 533 a base that fixes moving means 460 to receptacle 402.

Figure 28:
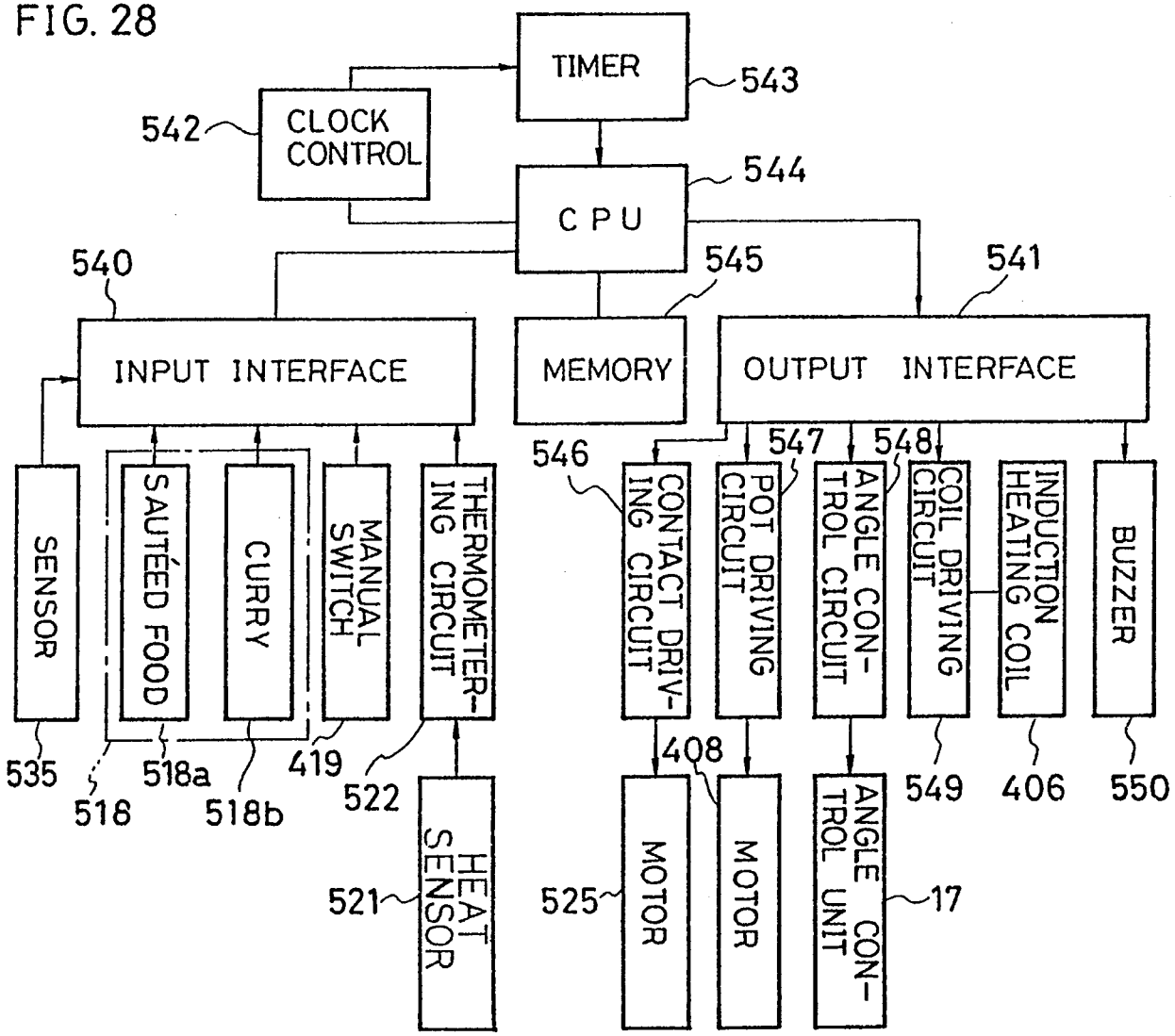
FIG. 28 is a block diagram of control means (23) shown in FIG. 26.
Figure 29A:
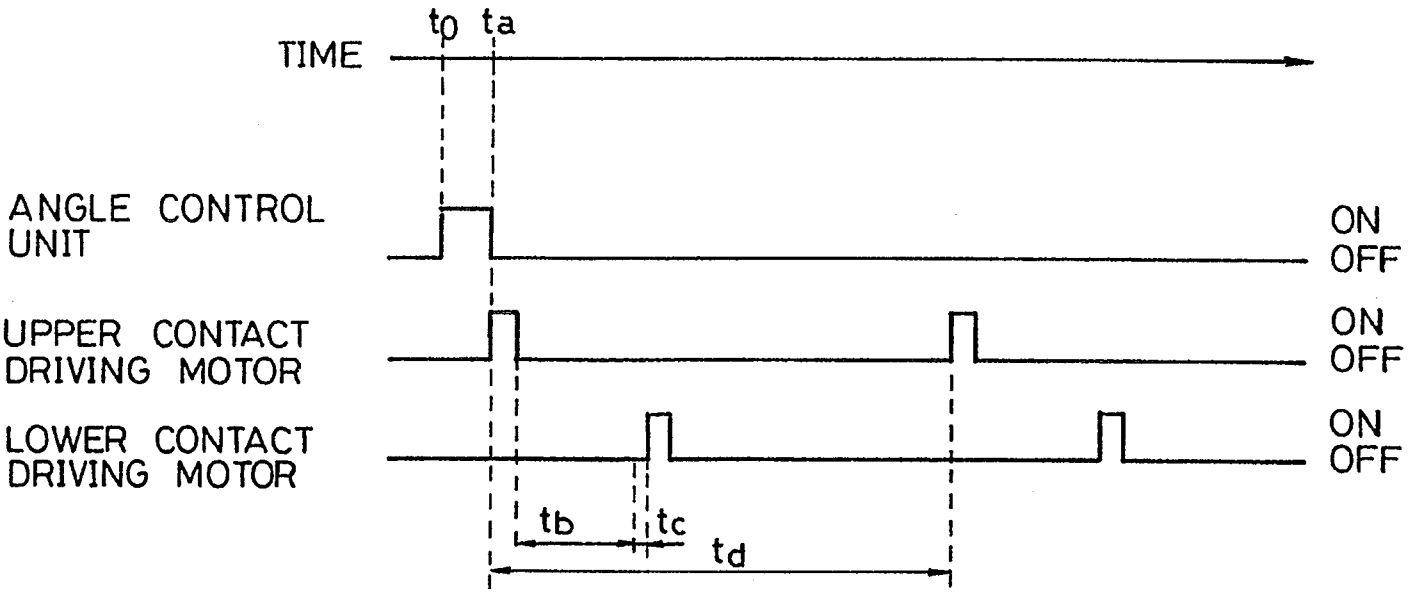
FIG. 29 (*a*) is a timing chart for the driving control of a contact of the embodiment, (*b*) timing chart showing the relationship between contact control and pot driving means control, (*c*) timing chart showing the relationship between contact control and induction heating coil control, and (*d*) timing chart showing the relationship between contact control and the control of pot driving means and induction heating coils.
Figure 29B:
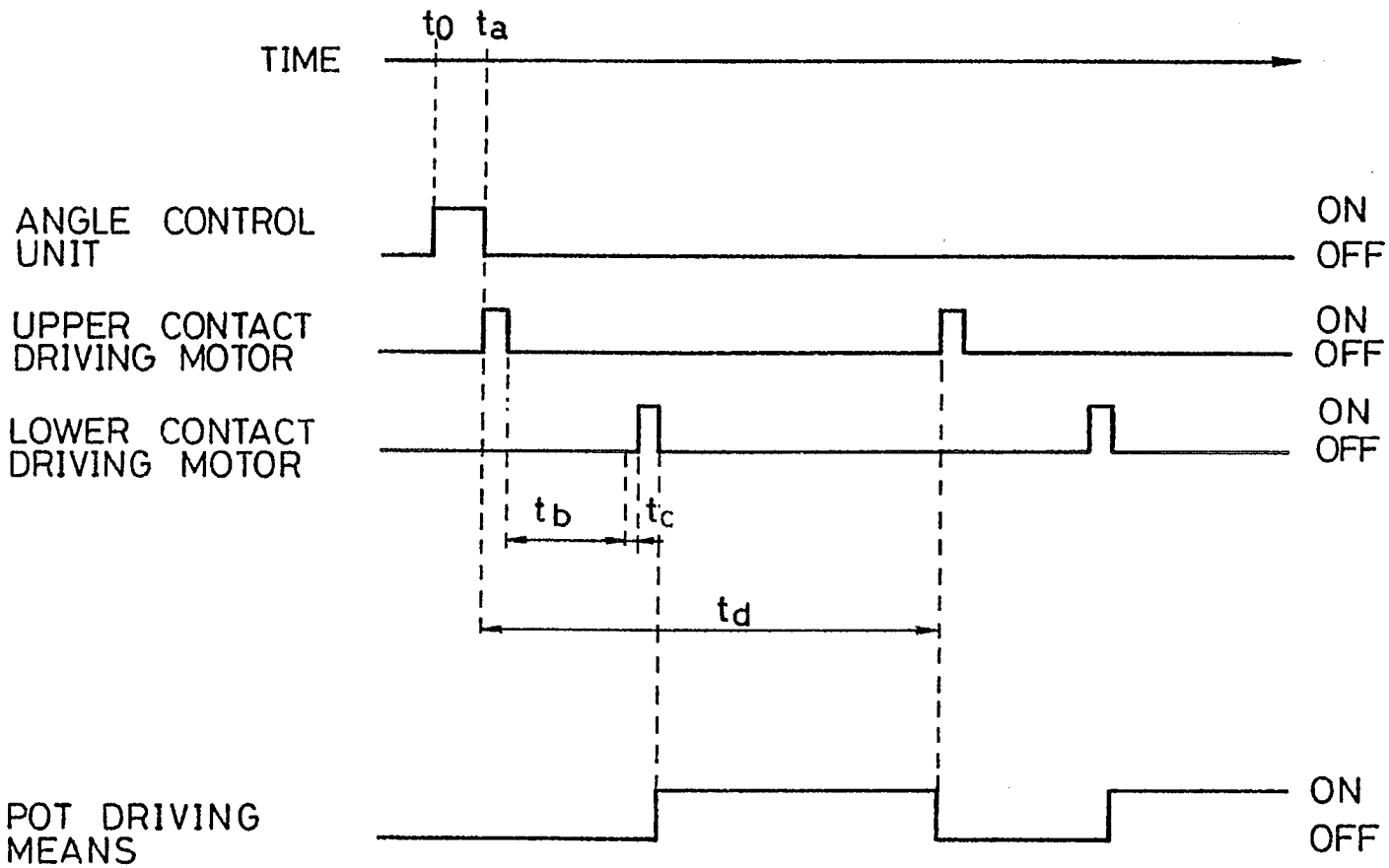
Figure 29C:
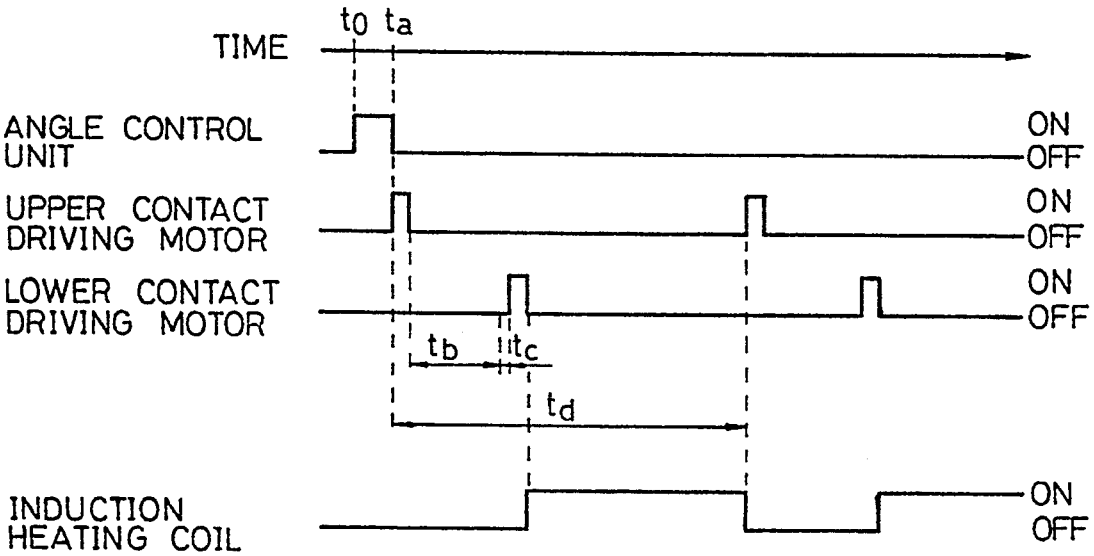
Figure 29D:
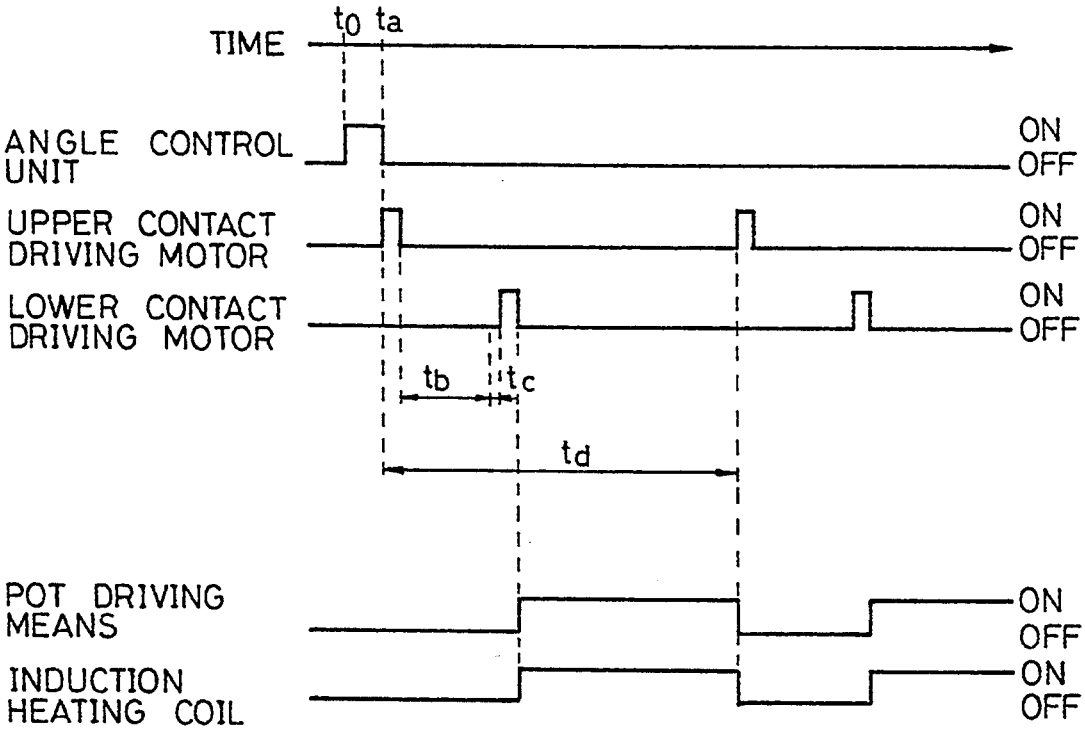

FIG. 28 is a block drawing of control means 423 of FIG. 26. In the figure, 540 is an input interface, 541 output interface, 542 clock control unit, 543 timer, 544 CPU, 545 memory for storing cooking programs executed by CPU 544 shown in FIG. 30 and information for the cooking courses of FIG. 31, 518*a* switch for sautéing, 518*b* switch for curry, 546 contact driving circuit, 547 pot driving circuit, 548 angle control circuit, 549 coil driving circuit, and 550 buzzer.

The operation of the cooker is explained next. FIG. 29 (*a*) is a timing chart that indicates the driving control of contact 520 in the embodiment of a cooker according to the invention. Here, angle control unit 417 changes the angle of receptacle 402 at time (to) and the angle adjustment ends at time (ta). Electricity is then applied to driving motor 525, which rotates gear 526 in the direction to cause contact 520 to rise upward and contact the bottom of cooking pot 407. Sensor 535 detects this condition, turns off the electricity to driving motor 525 and the temperature of heat sensor 521 is measured through temperature measuring circuit 422 for a duration of (tc) after an elapse of time (tb) during which the temperatures of heat sensor 521 and cooking pot 407 become the same. Time (tb) is determined on the basis of the shape of contact 520, the area of contact between it and cooking pot 407, and the heat capacity and other factors. The specification of (tc) as the measurement time aims at raising the reliability of the measurement data. After the temperature of cooking pot 407 has. been measured in this way, electricity is applied to driving motor 525 and gear 526 rotates reversely so that contact 520 is pulled downward through ring 537, separating contact 520 from the bottom of cooking pot 407. When sensor 535 detects this condition, it cuts the electricity to driving motor 525. The time (td) required for this series of actions from the lifting of contact 520 to the re-lifting of contact 520 is taken as one temperature measurement cycle. By repeating the cycle a number of times, the temperature of cooking pot 407 is measured intermittently. In this way, it is possible to decrease the amount of wear of contact 520 even when measuring the temperature of cooking pot 407 while it is rotating.

FIG. 29 (*b*) is a timing chart indicating the relationship between the control of contact 520 and the control of pot driving means 408. It shows that the rotation of cooking pot 407 is stopped during the time contact 520 is touching cooking pot 407, thereby sharply decreasing the amount of wear of contact 520.

FIG. 29 (*c*) is a timing chart indicating the relationship between the control of contact 520 and the control of induction heating coil 406. It shows that the heating of cooking pot 407 is stopped during the time contact 520 is touching cooking pot 407, thereby preventing the heating of contact 520 itself by electromagnetic induction, thus preventing damage to the temperature measuring circuit by electromagnetic induction.

FIG. 29 (*d*) is a timing chart indicating the relationship between the control of contact 520 and the control of both pot driving means 408 and induction heating coil 406. It shows that the rotation and induction heating of cooking pot 407 is stopped during the time contact 520 is touching cooking pot 407.

From FIGS. 29 (*a*) to (*d*), it is seen that temperature measurement may be started from time (to), which corresponds to the start of angle control unit 417.

Figure 30:
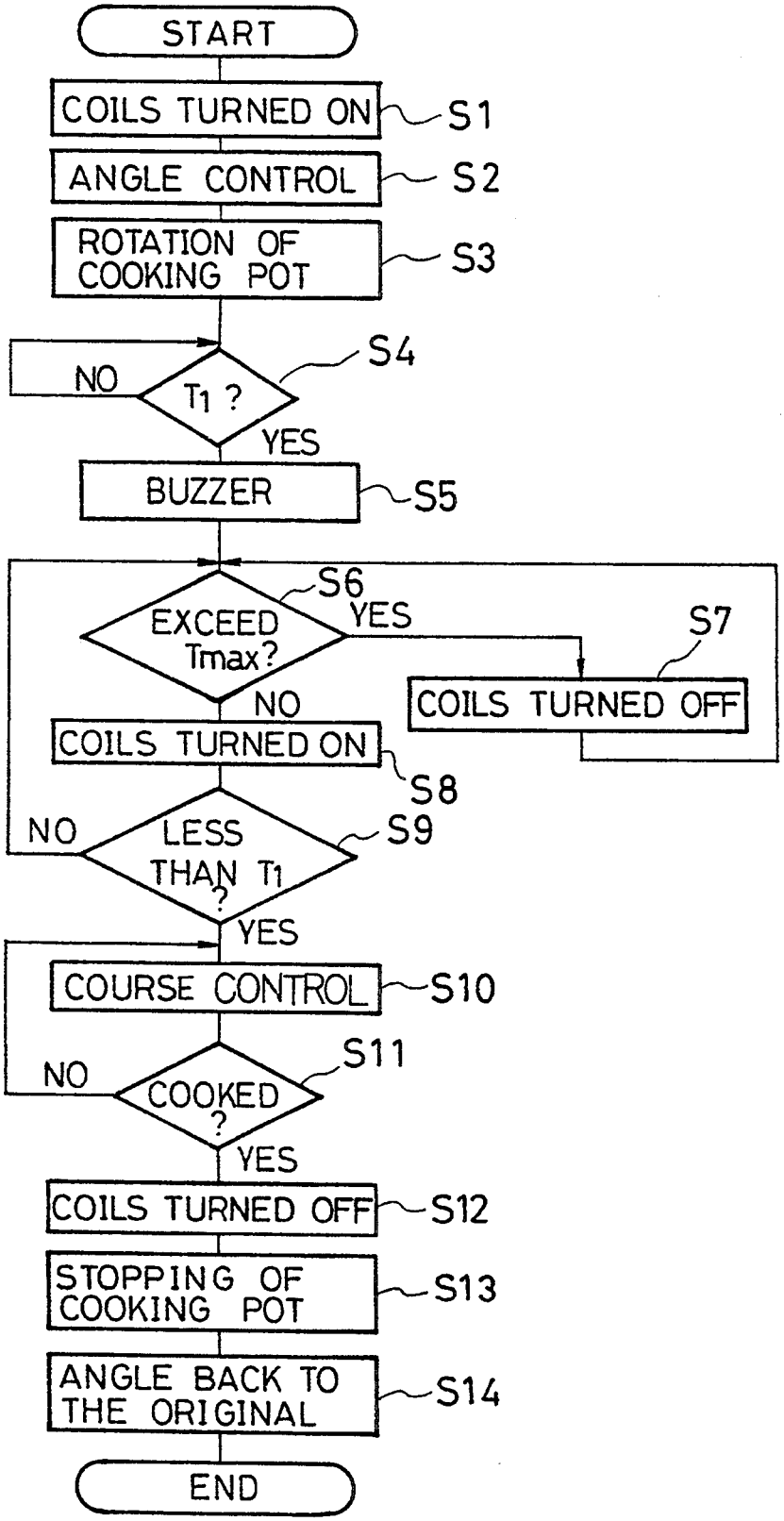
FIG. 30 is a flow chart of the cooking programs of the embodiment.
Figure 31:
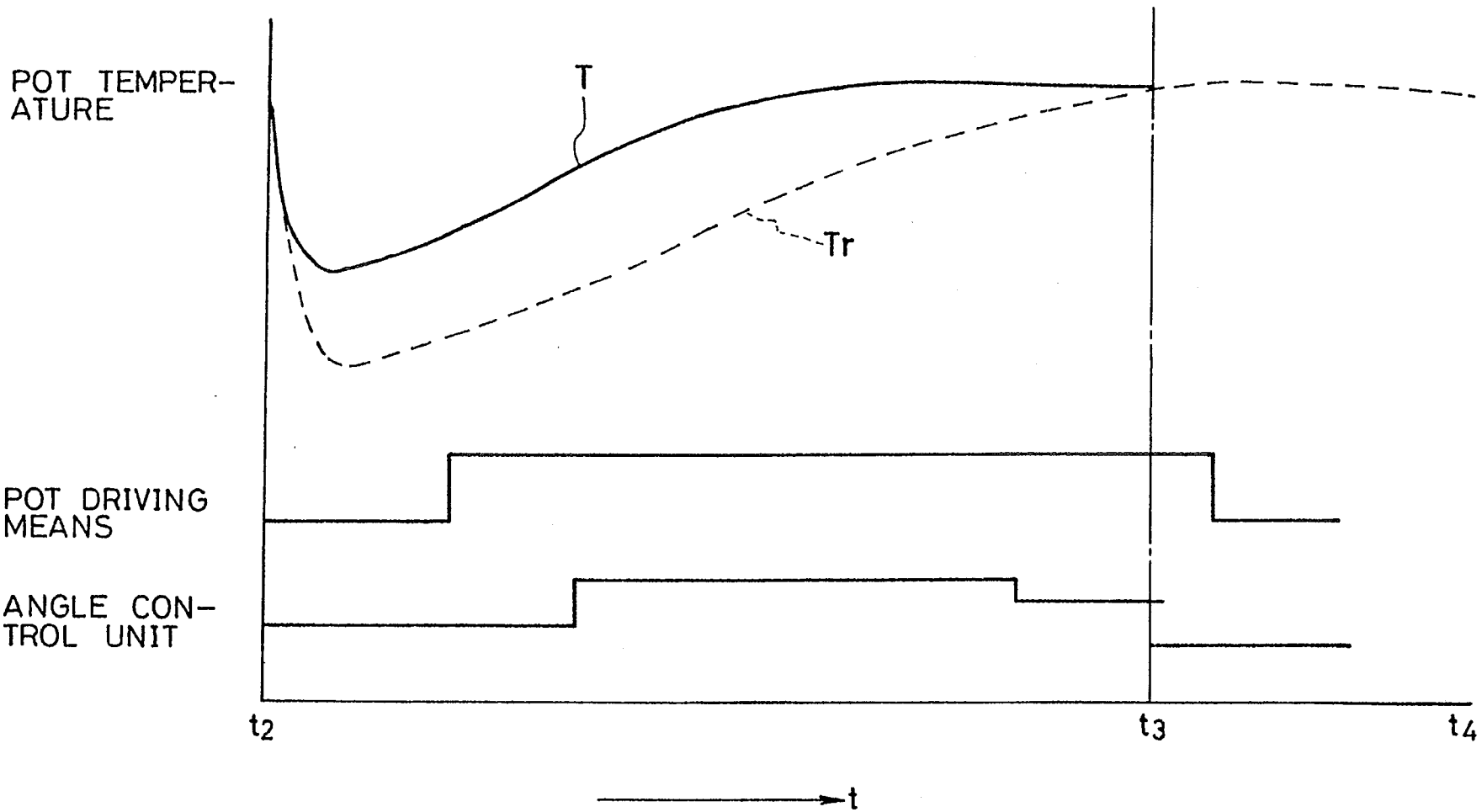
FIG. 31 is a diagram describing control information on the cooking courses of the embodiment.

FIG. 30 is a flowchart of the cooking programs for an embodiment of a cooker according the invention. FIG. 31 is a diagram explaining the control information for the cooking courses of the embodiment. In step S1, electricity is applied to induction heating coil 406. At the same time, in step S2, angle control unit 417 adjusts the inclination angle of receptacle 402. In step S3, cooking pot 407 is rotated. Step S4 is a waiting period for the temperature of cooking pot 407 to reach appropriate temperature T1. When the temperature reaches T1, buzzer 550 sounds in step S5 to inform the user that cooking pot 407 has reached the appropriate temperature. In step S6, a check of whether the temperature of cooking pot 407 has risen above the allowable maximum temperature Tmax. If it has, induction heating coil 406 is shut off in step S7. In this way, the user need not worry about overheating when away from the cooker. If in step S6 the temperature is found to be below Tmax, power is applied again to induction heating coil 406 in step S8. In step S9, the temperature is checked whether it is below T1. If not, oil or ingredients 514 are not added and the sequence returns to step S6. If the temperature is found to be below T1 in step S9, oil and ingredients 514 are added, and the sequence goes to step S10 in which cooking takes place according to the control information of the cooking course shown in FIG. 31.

In FIG. 31, cooking course information consists of pot temperature T according to time t, and control information for pot driving means 408 and angle control unit 417. For example, the curve of pot temperature T defines the standard change in the pot temperature after the addition of ingredients 514, etc. at time T2. As shown in the curve for pot temperature T, the temperature drops sharply when the specified amount of ingredients is added, then rises gradually as the ingredients are heated, finally reaching the proper temperature for the specified type of food. This temperature is maintained for a length of time specified for the food, after which cooking of the food is defined to be completed at time (t3). CPU 544 reads the cooking course control information from memory 545 at specified times and controls induction heating coil 406 so that the actual measurement temperature at each point conforms to the curve for pot temperature T. In the same way, it also controls pot driving means 408 and angle control unit 417 according to the control information of the cooking course. Thus, it becomes possible to change both the rotation speed of cooking pot 407 and the angle of cooking pot 407 according to the control information of the cooking course.

In case the amount of ingredients added to cooking pot 407 exceeds the specified amount, the curve of pot temperature T drops even more sharply and the rise in the temperature of the ingredients will lag behind as shown by curve Tr indicated as a dotted line in the figure. Thus it may be thought that cooking will not be completed by time (t3). However, even in such a case, CPU 544 can raise the level of power applied to induction heating coil 406 so that the change in actual pot temperature thereafter matches the curve of pot temperature T in the figure. Thus cooking can still be completed time (t3). Or, CPU 544 is able to ascertain the extent by which amount of ingredients exceeds the specified amount based on the actual drop in pot temperature, and respond by increasing the time interval for reading the information of pot temperature T from memory 545 based on the difference. As a result, cooking takes place according to temperature course Tr, and cooking can still be completed at time (t4). In this way, irregular amounts of ingredients can be properly cooked using only a single set of control information for a standard cooking course.

Returning to FIG. 30, when the completion of cooking is determined in step S11, power to induction heating coil 406 is cut step S12, rotation of cooking pot 407 is stopped in step S13, and receptacle 402 is returned to horizontal position in step S14.

Figure 32:
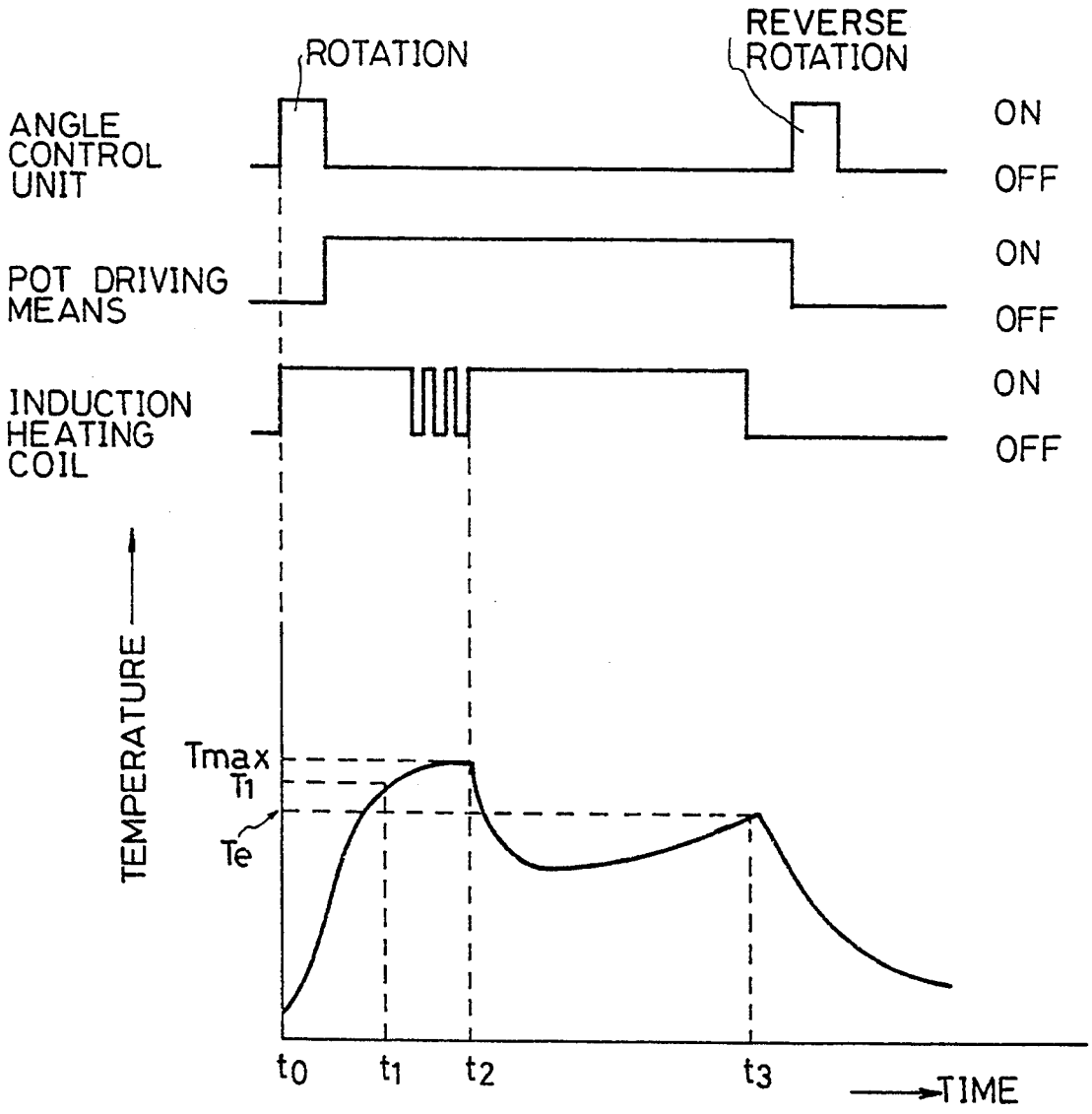
FIG. 32 is a timing chart describing the operation of an embodiment of a rotary cooker in the case of a sautéing course.

FIG. 32 is a timing chart for the operation of an embodiment of a rotary cooker according to the invention for a sauté course. In the figure, when cooking pot 407 is placed in receptacle 402 and cooking begins at time (to), angle control unit 417 changes the angle of receptacle 402, and at the same time, power is applied to induction heating coil 406. Afterwards, angle control unit 417 stops when the inclination of receptacle 402 reaches a specified angle, pot driving means 408 is activated and rotation of cooking pot 407 begins. From the start of cooking at (to), the temperature of cooking pot 407 is measured moment by moment. When the temperature T1 for adding oil is reached, buzzer 550 sounds to inform the user to add oil. After oil is added at time (t1), a certain length of time passes until the addition of ingredients 514, during which power to induction heating coil 406 is regulated so that the temperature of cooking pot 407 does not exceed the allowable maximum temperature Tmax. When ingredients 514 are added at time (t2), the temperature of pot 407 drops sharply, then after a while, begins to rise again. At time (t3) when temperature Te is reached, cooking is completed and power to induction heating coil 406 is cut. At this time, the temperature of cooking pot 407 is high, so pot driving means 408 continues to operate, mixing the ingredients to prevent them from burning. After a certain period of time or when it is ascertained that the cooking pot has dropped to a certain temperature, power to pot driving means 408 is cut and angle control unit 417 returns receptacle 402 to its original angle and cooking is completed. In this way, control is automatically conducted from the point when receptacle 402 begins to incline to the completion of cooking and the return of receptacle 402 to its original horizontal position.

In the above embodiment, contact 520 is designed to touch the center portion of the bottom of cooking pot 407; however, it may also be designed to touch another part of the bottom of cooking pot 407 or the surface of the outer side.

In the above embodiment, the means for moving contact 520 was indicated as a combination of rack and gear; however, this combination may be substituted with other means (such as a cam and link unit).

Moreover, since contact 520 is thermally linked with cooking pot 407, contact 520 would best be made of material with a high thermal conductivity ( such as aluminum).

As explained above, this invention makes it possible to heat a rotating cooking pot from the outside by induction heating and to make proper measurements of the temperature of a cooking pot by causing a contact incorporating a heat sensing element to come into or out of contact with the outside surface of the cooking pot. Moreover, since it controls the heating means based on both information that defines the change in cooking temperature and the actual measurement temperatures, it enables the user to produce uniform cooking results regardless of his or her cooking sense or experience, and therefore further simplifies the use of rotary cookers.

What is claimed is:

1. A cooker comprising:

a receptacle for holding a pot which holds ingredients;

means for heating the pot in the receptacle;

means for supporting the receptacle so that the pot is inclinable;

a motor for providing a driving force to the means for supporting to incline the receptacle; and a controller for controlling the motor.

2. The cooker of claim 1 wherein the means for supporting comprises:

a bracket rigidly coupled to the receptacle;

a first gear rigidly coupled to the bracket for rotating the bracket about an axis when the first gear rotates; and means for coupling the motor to the first gear.

3. The cooker of claim 1 further comprising a limit switch positioned to be contacted by the receptacle at a predetermined angle, and means for changing operation of the motor in response to activation of the limit switch.

4. The cooker of claim 1 further comprising:

means, coupled to the controller, for maintaining the receptacle at a desired angle.

5. The cooker of claim 1 wherein the pot has a bottom portion and side portions, the cooker further comprising a heater which comprises:

heating coils including a first coil for heating the bottom portion of the pot, and a second coil for heating the side portion of the pot; and means for controlling and switching the coils so that the first and second coils are operable separately or simultaneously.

6. The cooker of claim 1 further comprising an angle detector for detecting the angle of the receptacle, and memory for storing an angle setting program, wherein the controller controls the angle of incline of the receptacle in response to the detected angle and the angle setting program.

7. The cooker of claim 6 further comprising a timer and memory for storing an activation time setting program, wherein the controller controls the heater so that the heater heats the receptacle for a time indicated by the activation time setting program.

8. The cooker of claim 1 further comprising means for rotating the pot relative to the receptacle when the pot is in the receptacle.

9. A cooker having a receptacle for receiving a pot for holding ingredients, wherein the receptacle is supported by a main unit so that the pot is freely inclinable, the cooker comprising:

an angle control unit having a motor which provides a force; and means for coupling the motor to the receptacle so that the motor causes the receptacle to incline.

10. The cooker of claim 9 further comprising a controller for controlling the angle control unit.

11. The cooker of claim 9 wherein the pot has a bottom portion and side portions, the cooker further comprising a heater which comprises:

heating coils including a first coil for heating the bottom portion of the pot, and a second coil for heating the side portion of the pot; and means for controlling and switching the coils so that the first and second coils can be selectively controlled to are operable separately or simultaneously.

12. The cooker of claim 9 further comprising an angle detector for detecting the angle of the receptacle, and memory for storing an angle setting program, wherein the controller controls the angle of incline of the receptacle in response to the detected angle and the angle setting program.

13. A cooker having a receptacle for receiving a pot for holding ingredients and a heater for heating said pot by induction, wherein the receptacle is supported by a main unit so that the pot is inclinable, the cooker comprising:

an angle control unit which provides a driving force for inclining said receptacle; and a controller for controlling said angle control unit wherein the pot has a bottom portion and side portions, wherein the heater comprises: heating coils including a first coil for heating the bottom portion of the pot, and a second coil for heating the side portions of the pot; and means for controlling and switching the coils so that the first and second coils are operable separately or simultaneously.

14. The cooker of claim 13 further comprising a timer and memory for storing an activation time setting program, wherein the controller controls the heater so that the heater heats the receptacle for a time indicated by the activation time setting program.

15. The cooker of claim 13 further comprising means for rotating the pot relative to the receptacle when the pot is in the receptacle.

* * * * *